US008057001B2

(12) United States Patent
Shingyohuchi et al.

(10) Patent No.: US 8,057,001 B2
(45) Date of Patent: Nov. 15, 2011

(54) IMAGING APPARATUS

(75) Inventors: Mitsuru Shingyohuchi, Kanagawa (JP); Takashi Kimura, Kanagawa (JP); Hirotoshi Eguchi, Kanagawa (JP); Kunihiro Yamanaka, Kanagawa (JP); Takahiro Yoshida, Kanagawa (JP); Toshihito Kamei, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1145 days.

(21) Appl. No.: 11/547,952

(22) PCT Filed: Mar. 2, 2006

(86) PCT No.: PCT/JP2006/004658

§ 371 (c)(1),
(2), (4) Date: Oct. 6, 2006

(87) PCT Pub. No.: WO2006/093342

PCT Pub. Date: Sep. 8, 2006

(65) Prior Publication Data

US 2007/0211092 A1 Sep. 13, 2007

(30) Foreign Application Priority Data

Mar. 4, 2005 (JP) ..... 2005-059946
Mar. 8, 2005 (JP) ..... 2005-063222

(51) Int. Cl.
*B41J 29/38* (2006.01)

(52) U.S. Cl. ..... 347/10; 347/15; 347/11; 347/5

(58) Field of Classification Search ..... 347/10, 347/11, 15, 5, 57, 58
See application file for complete search history.

(56) References Cited

U.S. PATENT DOCUMENTS

| | | | | |
|---|---|---|---|---|
| 6,151,050 | A | 11/2000 | Hosono et al. | |
| 6,328,395 | B1 * | 12/2001 | Kitahara et al. | 347/9 |
| 6,382,753 | B1 | 5/2002 | Teramae et al. | |
| 6,488,349 | B1 | 12/2002 | Matsuo et al. | |
| 2001/0043241 | A1 * | 11/2001 | Takahashi et al. | 347/10 |
| 2002/0018083 | A1 | 2/2002 | Sayama | |
| 2002/0033852 | A1 | 3/2002 | Chang | |
| 2003/0007024 | A1 | 1/2003 | Fujimori | |
| 2003/0011653 | A1 | 1/2003 | Oikawa et al. | |

(Continued)

FOREIGN PATENT DOCUMENTS

CN 1273175 A 11/2000

(Continued)

OTHER PUBLICATIONS

Mar. 30, 2010 European official action in connection with counterpart European patent application No. EP 06 71 5479.

(Continued)

*Primary Examiner* — Matthew Luu
*Assistant Examiner* — Henok Legesse
(74) *Attorney, Agent, or Firm* — Cooper & Dunham LLP

(57) ABSTRACT

An imaging apparatus is provided that includes a liquid discharge head configured to discharge recording liquid as one or more recording liquid droplets; a drive waveform generating unit configured to generate a drive waveform including at least two drive signals within one printing period; a drive unit configured to input tone data, select a relevant drive signal from the drive waveform via a switch that switches on/off according to the tone data, and apply the selected drive signal to the liquid discharge head; and a transmitting unit configured to transmit the tone data to the drive unit plural times within one printing period, the tone data being configured at a plurality of bits per channel.

15 Claims, 32 Drawing Sheets

U.S. PATENT DOCUMENTS

| | | | | |
|---|---|---|---|---|
| 2004/0056909 | A1 | 3/2004 | Takahashi et al. | |
| 2004/0207671 | A1 * | 10/2004 | Kusunoki et al. | 347/10 |

FOREIGN PATENT DOCUMENTS

| | | | |
|---|---|---|---|
| CN | 1398723 | A | 2/2003 |
| EP | 0737586 | A1 | 10/1996 |
| EP | 1176013 | A2 | 1/2002 |
| EP | 1186410 | A2 | 3/2002 |
| JP | 10-193587 | | 7/1998 |
| JP | 2000-263775 | | 9/2000 |
| JP | 2001-26102 | | 1/2001 |
| JP | 2001-191526 | | 7/2001 |
| JP | 3219241 | | 8/2001 |
| JP | 2001-246738 | | 9/2001 |
| JP | 2001-277492 | | 10/2001 |
| JP | 3264422 | | 12/2001 |
| JP | 2002-46270 | | 2/2002 |
| JP | 2002-331692 | | 11/2002 |
| JP | 2003-1817 | | 1/2003 |
| JP | 2003-326748 | | 11/2003 |
| JP | 2005-41039 | | 2/2005 |

OTHER PUBLICATIONS

Jun. 6, 2008 Chinese official action (and English translation thereof) in connection with counterpart Chinese patent application No. 200680000202X.

* cited by examiner

FIG.25

| FIRST HALF | SECOND HALF | 1st PULSE | 2nd PULSE | 3rd PULSE | 4th PULSE | 5th PULSE | 6th PULSE |
|---|---|---|---|---|---|---|---|
| NON-DISCHARGE (0,0) | NON-DISCHARGE (0,0) | | | | | | |
| SMALL DROPLET (0,1) | NON-DISCHARGE (0,0) | DISCHARGE | | | | | |
| MEDIUM DROPLET (1,0) | NON-DISCHARGE (0,0) | DISCHARGE | DISCHARGE | | | | |
| LARGE DROPLET (1,1) | NON-DISCHARGE (0,0) | DISCHARGE | DISCHARGE | DISCHARGE | | | |
| LARGE DROPLET (1,1) | SMALL DROPLET (0,1) | DISCHARGE | DISCHARGE | DISCHARGE | DISCHARGE | | |
| LARGE DROPLET (1,1) | MEDIUM DROPLET (1,0) | DISCHARGE | DISCHARGE | DISCHARGE | DISCHARGE | DISCHARGE | |
| LARGE DROPLET (1,1) | LARGE DROPLET (1,1) | DISCHARGE | DISCHARGE | DISCHARGE | DISCHARGE | DISCHARGE | DISCHARGE |

FIG.27

| FIRST HALF | SECOND HALF | 1st PULSE | 2nd PULSE | 3rd PULSE | 4th PULSE | 5th PULSE | 6th PULSE |
|---|---|---|---|---|---|---|---|
| NON-DISCHARGE (0,0) | NON-DISCHARGE (0,0) | | | | | | |
| SMALL DROPLET (0,1) | NON-DISCHARGE (0,0) | DISCHARGE | | | | | |
| MEDIUM DROPLET (1,0) | NON-DISCHARGE (0,0) | | DISCHARGE | | | | |
| LARGE DROPLET (1,1) | NON-DISCHARGE (0,0) | | DISCHARGE | DISCHARGE | | | |
| LARGE DROPLET (1,1) | SMALL DROPLET (0,1) | | DISCHARGE | DISCHARGE | DISCHARGE | | |
| LARGE DROPLET (1,1) | MEDIUM DROPLET (1,0) | | DISCHARGE | DISCHARGE | DISCHARGE | DISCHARGE | |
| LARGE DROPLET (1,1) | LARGE DROPLET (1,1) | | DISCHARGE | DISCHARGE | DISCHARGE | DISCHARGE | DISCHARGE |

FIG.29

| FIRST HALF | SECOND HALF | 1st PULSE | 2nd PULSE | 3rd PULSE | 4th PULSE | 5th PULSE | SUBTLE DRIVE | 6th PULSE |
|---|---|---|---|---|---|---|---|---|
| NON-DISCHARGE (0,0) | NON-DISCHARGE (0,0) | | | | | | ○ | |
| SMALL DROPLET (0,1) | NON-DISCHARGE (0,0) | DISCHARGE | | | | | ○ | |
| MEDIUM DROPLET (1,0) | NON-DISCHARGE (0,0) | | DISCHARGE | | | | ○ | |
| LARGE DROPLET (1,1) | NON-DISCHARGE (0,0) | | DISCHARGE | DISCHARGE | | | ○ | |
| LARGE DROPLET (1,1) | SMALL DROPLET (0,1) | | DISCHARGE | DISCHARGE | DISCHARGE | | | |
| LARGE DROPLET (1,1) | MEDIUM DROPLET (1,0) | | DISCHARGE | DISCHARGE | DISCHARGE | DISCHARGE | | |
| LARGE DROPLET (1,1) | LARGE DROPLET (1,1) | | DISCHARGE | DISCHARGE | DISCHARGE | DISCHARGE | | DISCHARGE |

FIG.31

| FIRST HALF | SECOND HALF | 1st PULSE | 2nd PULSE | 3rd PULSE | 4th PULSE | 5th PULSE | 6th PULSE |
|---|---|---|---|---|---|---|---|
| NON-DISCHARGE (0,0) | | | | | | | |
| SMALL DROPLET (0,1) | | DISCHARGE | | | | | |
| MEDIUM DROPLET (1,0) | | DISCHARGE | DISCHARGE | | | | |
| | NON-DISCHARGE (0,0) | | | | | | |
| | SMALL DROPLET (0,1) | | | | | DISCHARGE | |
| | MEDIUM DROPLET (1,0) | | | | | DISCHARGE | DISCHARGE |
| LARGE DROPLET (1,1) | LARGE DROPLET (1,1) | DISCHARGE | DISCHARGE | DISCHARGE | DISCHARGE | DISCHARGE | DISCHARGE |

FIG.35

| FIRST HALF | SECOND HALF | 1st PULSE | 2nd PULSE | 3rd PULSE | 4th PULSE | 5th PULSE | 6th PULSE | 7th PULSE | 8th PULSE |
|---|---|---|---|---|---|---|---|---|---|
| NON-DISCHARGE (0, 0) | | | | | | | | | |
| SMALL DROPLET (0, 1) | | | DISCHARGE | | | | | | |
| MEDIUM DROPLET (1, 0) | | DISCHARGE | | | | | | | |
| | NON-DISCHARGE (0, 0) | | | | | | | | |
| | SMALL DROPLET (0, 1) | | | | | | DISCHARGE | | |
| | MEDIUM DROPLET (1, 0) | | | | | DISCHARGE | | | |
| LARGE DROPLET (1, 1) | LARGE DROPLET (1, 1) | DISCHARGE | DISCHARGE | DISCHARGE | DISCHARGE | DISCHARGE | | DISCHARGE | DISCHARGE |

IMAGING APPARATUS

TECHNICAL FIELD

This disclosure relates to an imaging apparatus that includes a liquid discharge head configured to discharge one or more droplets of recording liquid.

BACKGROUND ART

An imaging apparatus such as a printer, a facsimile machine, a copier, a plotter, or a printer/fax/copier multifunction machine may be a serial imaging apparatus as is described below or a line imaging apparatus including a line recording head, for example. A serial imaging apparatus includes a carriage in which a liquid discharge head configured to discharge droplets of recording liquid (e.g., ink) is arranged as a recording head (print head), and is configured to drive the carriage to serially scan a recording medium in a direction perpendicular to the conveying direction of the recording medium (also referred to as 'paper', 'recording paper', or 'transfer material' hereinafter). The serial imaging apparatus is configured to intermittently convey the recording medium according to a recording width, and form (record/print) an image on the recording medium by repeatedly alternating between conveying the recording medium and recording an image thereon.

An imaging apparatus as is described above that uses a liquid discharge head may realize multi-level tone printing by configuring the liquid discharge head to discharge liquid droplets in different sizes (e.g., small droplet, medium droplet, and large droplet) to thereby form dots in different sizes.

For example, Japanese Patent No. 3264422 discloses an imaging apparatus that uses a drive waveform including a first drive pulse for discharging a first ink droplet within a printing period and a second drive pulse for discharging a second ink droplet of a different size from the first ink droplet within the printing period, and combining the first pulse and the second pulse to selectively form dots in four or more different tones.

According to the above disclosure, print data of one bit per channel (1 bit/CH) are transmitted to a head driver for every drive pulse of a drive waveform. In this example, one channel refers to a unit including one nozzle, its corresponding liquid chamber and pressure generating means.

In the following, the data transmitting method used in the above disclosure is described in detail below with reference to FIG. 1. Print data are serially transmitted by a clock and registered in a shift register. The print data are latched by a latch signal (LAT) having a timing corresponding to the interval of the drive pulse so that the on/off state of an analog switch (switch means) for each channel may be determined. Specifically, previous print data are reflected in the current print data (e.g., if the current print data corresponds to medium droplet, print data transmitted for large droplet are reflected). In this example, a portion of a common drive waveform is applied to pressure generating means (piezoelectric element) to discharge liquid droplets of different sizes.

However, according to the above drive method, data transmission has to be completed at periods corresponding to the period of the drive pulse with the shortest pulse width used for on/off switching. Therefore, data transmission may be constrained by the requirement of a high clock frequency for data transmission, for example. Also, when the number of channels is increased in order to increase the printing speed, the pulse width of the drive pulse is decreased, and thereby, the data transmission time is rate limiting with respect to the printing speed. On the other hand, it is noted that according to this data transmitting method, since the switch means may be selectively switched on/off for every drive pulse, in principle, the number of tone levels may be increased to $2^n$ (n representing the number of drive pulses within one printing period).

Japanese Patent No. 3219241 discloses a technique for decreasing the data transmission amount and the number of signal lines by providing storage means (shift register) and translating means, and controlling the operation of switching means based on print data decoded from a common drive waveform made up of plural drive pulses arranged within one printing period. By providing the translating means, data transmission of print data for one printing period may be realized at two bits per channel (2 bits/CH) in the case of four-level tone printing, for example.

According to the above-described data transmitting method, data are transmitted once in every printing period rather than in every drive pulse interval. Thereby, data transmission time appropriate for the number of channels and printing speed may be realized, and the load of the data transmission unit may be reduced. According to the present example, in the case of realizing data transmission at 2 bits/CH, the number of tone levels that may be realized is limited to four levels (i.e., large, medium, small, null). It is noted that the number of tone levels may be increased by increasing the number of bits (e.g., eight tone levels may be realized at 3 bits/CH); however, increasing the number of bits leads to an increase in the number of circuit elements within the head driver which results in cost increase as well as an increase in the data transmission amount.

Japanese Laid-Open Patent Publication No. 2003-1817 discloses a technique involving transmitting tone data and selecting a portion of a common drive waveform according to a corresponding control signal for the tone data.

In the following, the above-described data transmitting method is described in detail with reference to FIG. 2. Two bits of tone signals 0 and 1 are transmitted on separate signal lines and registered in a shift register. The tone (i.e., large, medium, small, or null) of each channel is determined by the first latch signal of a printing period. The tone of each channel determines the on/off state of a corresponding switch based on its corresponding control signal. Specifically, when the tone of a channel is set to large droplet (1, 1), an on/off state of an analog switch is determined based on a signal transmitted on a large droplet line of control signal lines.

It is noted that this transmitting method is similar to the method illustrated in FIG. 1 in that different waveforms are selected for large/medium/small droplets; however, in the present transmission as is illustrated in FIG. 2, the waveform selection switching may be realized even when the required processing time for a medium droplet is shorter than the data transmission time, and the data transmission amount may be reduced.

It is noted that the techniques disclosed in Japanese Patent No. 3219241 and Japanese Laid-Open Patent Publication No. 2003-1817 employ different methods for switching on/off an analog switch according to each tone; however, the two techniques both employ the data transmitting method involving transmitting tone data once in every printing period and selecting the portion of a common waveform to which pressure is to be applied based on the transmitted tone data.

It is noted that an imaging apparatus may be configured to realize non-interlaced one-pass printing as a high speed printing mode. In this printing mode, an image may be formed in one scan so that high speed printing may be realized.

In non-interlaced printing, the resolution in the sub scanning direction is arranged to equal the nozzle pitch of the recording head. Accordingly, in this case, the largest droplet size (e.g., large droplet) has to have a corresponding droplet discharge amount that is sufficient for forming a solid image.

However, in a recording head using an electromechanical conversion element (e.g., piezoelectric element), the machinability is limited to the nozzle pitch, and thereby, the resolution may not be adequately increased. With the present technology, the resolution is limited to approximately 180 dpi for one-line printing, and approximately 360 dpi for two-line-staggered printing, for example. In this case, a discharge amount of approximately 30-50 pl (the amount is subject to change depending on the type of paper/ink used) is required in order to form a solid line image in one scan.

On the other hand, with the demand for higher image quality, techniques are being developed for obtaining a smaller sized droplet in high image quality mode. It is noted that the discharge amount for a small droplet is preferably less than 2 pl at approximately 1.5 pl, and is expected to be reduced further to approximately 1 pl in future applications.

As can be appreciated from the above descriptions, an imaging apparatus that enables changing the droplet size (discharge amount) over a wider range is in demand.

However, in the case of varying the discharge amount over a wide range, it may be difficult to control the droplet size through the discharge of one droplet. Accordingly, in many cases, a large droplet is formed by discharging plural droplets of recording liquid. It is noted that with the increase in the range for varying the droplet sizes, there is a growing tendency towards decreasing a discharge amount Mj per one droplet and increasing the number of droplets to be discharged for realizing a designated droplet size. Also, it is noted that instead of simply discharging a number of droplets, each droplet may be merged before being adhered to paper in order to facilitate forming a solid image in the sub scanning direction.

When the number of droplets discharged within one printing period is increased, the discharging interval (pulse interval) is reduced. In such a case, it may be difficult to realize transmission of print data at every drive pulse as is described above (e.g., Japanese Patent No. 3264422), and data transmission involving transmitting tone data of two or more bits and employing translating means and selecting means (e.g., Japanese Patent No. 3219241, and Japanese Laid-Open Patent Publication No. 2003-1817) may be preferred.

However, even when the data transmitting method as is disclosed in Japanese Patent No. 3219241 and Japanese Laid-Open Patent Publication No. 2003-1817 is used, the following problems may arise. Specifically, when the number of tones is greater than or equal to the number of drive pulses (=number of discharged droplets) generated within one printing period, there may be a great difference in droplet size from one tone level to a next tone level.

For example, FIG. 3 shows a case in which tone data of four tone levels (two bits) are transmitted using a drive waveform having four drive pulses (referred to as first, second, third, and fourth pulses, respectively). In this case, there is at least a difference of two pulses (two droplets) between one tone level and a next tone level. In this example, the first pulse is selected for a small droplet, the first and second pulses are selected for a medium droplet, and the first through fourth pulses are selected for a large droplet; that is, there is a difference of two droplets between the medium droplet and the large droplet.

When a difference in droplet size between one tone level to a next tone level is large, inconveniences are created in realizing a smooth continuous-tone image, and the graininess of the large droplets may stand out from a halftoning process.

Such a problem becomes prominent as the droplet size of a small droplet is decreased and the number of droplets to be discharged for forming a large droplet is increased. For example, FIG. 4 shows a case in which tone data of four tone levels (two bits) are transmitted using a drive waveform having six pulses (referred to as first through sixth pulses, respectively). In this example, the first pulse is selected for a small droplet, the first through third pulses are selected for the medium droplet, and the first through sixth pulses are selected for the large droplet. Accordingly, there is a difference of two droplets between the small droplet and the medium droplet, and there is a difference of three droplets between the medium droplet and the large droplet.

In such a case, the number of tone levels may be increased to thereby control the droplet size in greater detail; however, increasing the number of tone levels, namely, increasing the number of bits leads to cost increase. In other words, although more detailed control of the droplet size may be realized by increasing the number of droplets to be discharged, in practice, such detailed control of the droplet size is restricted by limitations in the number of tone levels, for example.

Also, it is noted that an imaging apparatus may be arranged to form an image using differing resolutions for main scanning and sub scanning. For example, main scanning may be performed at 600 dpi, and sub scanning may be performed at 300 dpi. It is noted that in a serial imaging apparatus, when the nozzle alignment direction is in the sub scanning direction, although the resolution in the sub scanning direction is determined by the nozzle pitch, the resolution in the main scanning direction is determined by the carriage speed and the printing period. Therefore, the resolution in the main scanning direction may be adjusted with relative ease through adjusting the carriage speed. In this way, the resolution in the main scanning direction may be increased.

FIGS. 5A and 5B show examples in which images are formed at (main scanning resolution)×(sub scanning resolution)=300 dpi×300 dpi, and FIGS. 6A and 6B show examples in which images are formed at (main scanning resolution)×(sub scanning resolution)=600 dpi×300 dpi.

As can be appreciated from the illustrated examples, by increasing the resolution in the main scanning direction, the discharge amount for forming a large droplet may be reduced. However it is noted that even when the resolution in the main scanning direction is doubled as in the example of FIG. 6A, since ink has to be adequately applied in the sub scanning direction to form a solid image, the discharge amount for forming the large droplet may not be reduced to half the amount used in the example of FIG. 5A. Also, in order to maintain the printing speed in the example of FIGS. 6A and 6*b* to that of the example of FIGS. 5A and 5B, the drive frequency for the recording head has to be doubled so that difficulties may be created with respect to discharge control. For example, it is more difficult to control discharge of a liquid droplet of 20 pl at a drive frequency of 20 kHz compared to a case of controlling discharge of a liquid droplet of 40 pl at a drive frequency of 10 kHz.

FIG. 7 is a graph indicating the increase in the total discharge amount (droplet volume Mj) of liquid resulting from increasing the number of droplets discharged (drive pulse number), and the droplet volume Mjp of the liquid droplet discharged by each of the drive pulses. As is illustrated in this drawing, the total droplet volume Mj for forming a designated droplet may increase in an approximately linear manner in accordance with the increase in the number of drive pulses (individual droplet number); however, the droplet volume of the individual droplets (before being combined into a single droplet) discharged by the respective pulses for forming the designated droplet vary in a manner such that the droplet discharged by a later pulse is greater in volume than that discharged by an earlier pulse.

Such a phenomenon occurs owing to the fact that in the case of discharging plural droplets, the meniscus of liquid rises by the discharge of a droplet so that droplets discharged later may be larger in volume. For example, in FIG. 7, six droplets are combined to form one single droplet of approximately 37 pl. In this case, the total droplet amount (volume) of the first three droplets discharged by the first through third drive pulses, respectively, is approximately 15 pl, which is approximately 40% of the total droplet volume of the droplet to be formed.

In the case of varying the resolutions in the main scanning direction and the sub scanning direction as is described with reference to FIGS. 6A and 6B (e.g., 600 dpi×300 dpi), the droplets have to be configured to form a solid image in the sub scanning direction, and thereby, even when the resolution in the main scanning direction is doubled, the discharge amount may not be reduced to half the original amount and difficulties may arise with respect to control.

However it is noted that by increasing at least the resolution in the main scanning direction, the range of densities that may be represented only by small droplets may be widened so that a smooth continuous-tone image may be realized and the graininess of an image may be prevented from being degraded by a large droplet that may stand out in the tone image. Also, shagginess correction may be realized on characters and generation of jagged lines may be prevented.

It is noted that the droplet discharging interval has to be controlled more strictly as the number of droplets discharged within one printing period is increased for forming a large droplet that can fill up a solid image region. When the number of droplets to be discharged is increased, it becomes impossible to wait until the pressure within the liquid chamber of the recording head is adequately attenuated before discharging a next droplet. Thereby, the droplets have to be efficiently discharged in accordance with the pressure vibration of the liquid chamber and the pressure of the liquid chamber has to be controlled so that the pressure vibration does not go out of control. In this respect, the time and voltage of a drive waveform for forming a large droplet has to be adequately controlled.

SUMMARY

In an aspect of this disclosure, an imaging apparatus is provided that is capable of realizing high-speed printing and high-quality printing at the same time. In another specific aspect, an imaging apparatus is provided that realizes high-quality high-speed printing by increasing the number of tone levels that may be represented without increasing the bit number of tone data.

In a specific embodiment, an imaging apparatus is provided that includes:

a liquid discharge head configured to discharge recording liquid as one or more recording liquid droplets;

a drive waveform generating unit configured to generate a drive waveform including at least two drive signals within one printing period; and a drive unit configured to input tone data, select a relevant drive signal from the drive waveform via a switch that switches on/off according to the tone data, and apply the selected drive signal to the liquid discharge head;

wherein the drive signals of the drive waveform include a first drive signal for forming one dot with a large droplet in one printing period, and at least one of a second drive signal for forming at least two dots with at least two small droplets in one printing period and a third drive signal for forming at least two dots with at least two medium droplets in one printing period.

According to another specific embodiment, an imaging apparatus is provided that includes:

a liquid discharge head configured to discharge recording liquid as one or more recording liquid droplets;

a drive waveform generating unit configured to generate a drive waveform including at least two drive signals within one printing period; and a drive unit configured to input tone data, select a relevant drive signal from the drive waveform via a switch that switches on/off according to the tone data, and apply the selected drive signal to the liquid discharge head;

wherein the drive signals of the drive waveform include a first drive signal for forming one dot with a large droplet, and at least one of a second drive signal for forming one dot with a small droplet and a third drive signal for forming one dot with a medium droplet, the first drive signal being realized by repeating the at least one of the second drive signal and the third drive signal at least two times within one printing period.

According to a preferred embodiment, the large droplet is formed by discharging plural recording liquid droplets, and arranging the discharged recording liquid droplets to merge before they land on an imaging medium.

According to another preferred embodiment, the large droplet is formed by discharging at least four of the recording liquid droplets.

According to another preferred embodiment, the first drive signal for forming one dot with the large droplet includes at least one of a drive signal for forming one dot with a small droplet and a drive signal for forming one dot with a medium droplet.

According to another preferred embodiment, the tone data are switched within one printing period.

According to another preferred embodiment, the liquid discharge head, the drive waveform generating unit, and the drive unit are configured to realize serial imaging using an imaging mode in which a main scanning resolution is arranged to be higher than a sub scanning resolution except for a case in which one dot is formed by the large droplet within one printing period in which case the main scanning resolution and the sub scanning resolution are arranged to be equal.

According to another preferred embodiment, the imaging mode involves forming an image using a non-interlaced imaging scheme.

According to another preferred embodiment, the recording liquid includes pigment and has a viscosity of at least 5 mPa·s at a temperature of 23° C.

According to another specific embodiment, an imaging apparatus is provided that includes:

a liquid discharge head configured to discharge recording liquid as one or more recording liquid droplets;

a drive waveform generating unit configured to generate a drive waveform including at least two drive signals within one printing period;

a drive unit configured to input tone data, select a relevant drive signal from the drive waveform via a switch that switches on/off according to the tone data, and apply the selected drive signal to the liquid discharge head; and a transmitting unit configured to transmit the tone data to the drive unit plural times within one printing period, the tone data being configured at plural bits per channel.

According to a preferred embodiment, when the liquid discharge head is driven to discharge plural recording liquid droplets, the discharged recording liquid droplets are arranged to be merged to form one single droplet before landing on an imaging medium.

According to another preferred embodiment, the number of droplets to be discharged by the drive signals included within one printing period of the drive waveform exceeds the number of tone levels represented by the tone data.

According to another preferred embodiment, the number of droplets to be discharged by the drive signals included within one printing period of the drive waveform is greater than or equal to four.

According to another preferred embodiment, a transmitting timing for transmitting the tone data within one printing period is configured to be adjustable.

According to another preferred embodiment, the liquid discharge head, the drive waveform generating unit, the drive unit, and the transmitting unit are configured to realize mode switching between a mode involving transmitting the tone data plural times within one printing period and a mode involving transmitting the tone data once within one printing period.

According to another preferred embodiment, the drive signals of the drive waveform include at least one drive signal for discharging plural recording liquid droplets to form a large droplet, and this drive signal is configured to be used as a drive signal for discharging one or more of the recording liquid droplets to form a droplet other than the large droplet according to the tone data transmitted after a first transmission within one printing period.

According to another preferred embodiment, the drive signals of the drive waveform include at least two drive signals for discharging at least two droplets of substantially a same size at least two times within one printing period.

According to another preferred embodiment, the at least two drive signals for discharging the at least two droplets of substantially the same size at least two times are not used for discharging droplets of other sizes.

According to another preferred embodiment, the at least two drive signals for discharging the at least two droplets of substantially the same size at least two times are used for discharging droplets of other sizes.

According to another specific embodiment, a serial imaging apparatus is provided that realizes tone level representation with respect to one pixel and forms an image using an imaging mode involving arranging a main scanning resolution to be higher than a sub scanning resolution, the serial imaging apparatus including:

a liquid discharge head configured to discharge one or more recording liquid droplets for forming a droplet which droplet is arranged to be in one of plural different sizes;

wherein the imaging mode involves arranging the main scanning resolution to equal the sub scanning resolution in a case where the droplet formed by the one or more recording liquid droplets corresponds to a large droplet.

According to a preferred embodiment, the serial imaging apparatus of the present invention further includes:

a drive waveform generating unit configured to generate a drive waveform including plural drive signals within one printing period;

a drive unit configured to input tone data, select a relevant drive signal from the drive waveform via a switch that switches on/off according to the tone data, and apply the selected drive signal to the liquid discharge head; and a transmitting unit configured to transmit the tone data to the drive unit plural times within one printing period, the tone data being configured at plural bits per channel;

wherein when the large droplet is formed by plural recording liquid droplets, the recording liquid droplets for forming the large droplet are discharged based on a reference signal corresponding to a carriage position, and the transmission timing for transmitting the tone data after a first transmission within one printing period is set according to the reference signal.

According to another preferred embodiment, the drive signals of the drive waveform include at least one drive signal for discharging the one or more recording liquid droplets for forming the large droplet, and this drive signal is configured to be used as a drive signal for discharging one or more recording liquid droplets for forming a droplet other than the large droplet according to the tone data transmitted after a first transmission within one printing period.

According to another preferred embodiment, the imaging mode involving arranging the main scanning resolution to equal the sub scanning resolution upon forming the large droplet involves forming an image using an interlaced imaging scheme.

According to an aspect, by transmitting tone data at plural bits per channel to a drive unit plural times within one printing period, the substantial number of tone levels represented by the tone data may be increased without increasing the bit number of the tone data so that high-quality and high-speed printing may be realized.

According to another aspect, by implementing an imaging mode in which the main scanning resolution is arranged to be higher than the sub scanning resolution, and arranging the main scanning resolution to equal the sub scanning resolution in the case of forming a large droplet, a solid image region may be adequately covered by the large droplet with respect to the sub scanning direction and the main scanning resolution for the small droplet may be increased at the same time so that the image quality may be improved and high-speed printing may be realized.

BRIEF DESCRIPTION OF THE DRAWINGS

Other aspects, features and advantages will become more apparent from the following detailed description when read in conjunction with the accompanying drawings.

FIG. 25 is a table indicating whether droplets are discharged by the respective drive pulses of the drive waveform of the third embodiment according to control signals;

FIG. 27 is a table indicating whether droplets are discharged by the respective drive pulses of the drive waveform of the fourth embodiment according to control signals;

FIG. 29 is a table indicating whether droplets are discharged by the respective drive pulses of the drive waveform of the fifth embodiment according to control signals;

FIG. 31 is a table indicating whether droplets are discharged by the respective drive pulses of the drive waveform of the sixth embodiment according to control signals;

FIG. 35 is a table indicating whether droplets are discharged by the respective drive pulses of the drive waveform of the seventh embodiment according to control signals.

BEST MODE FOR CARRYING OUT THE INVENTION

In the following, preferred embodiments of the present invention are described with reference to the accompanying drawings.

Figure 8:
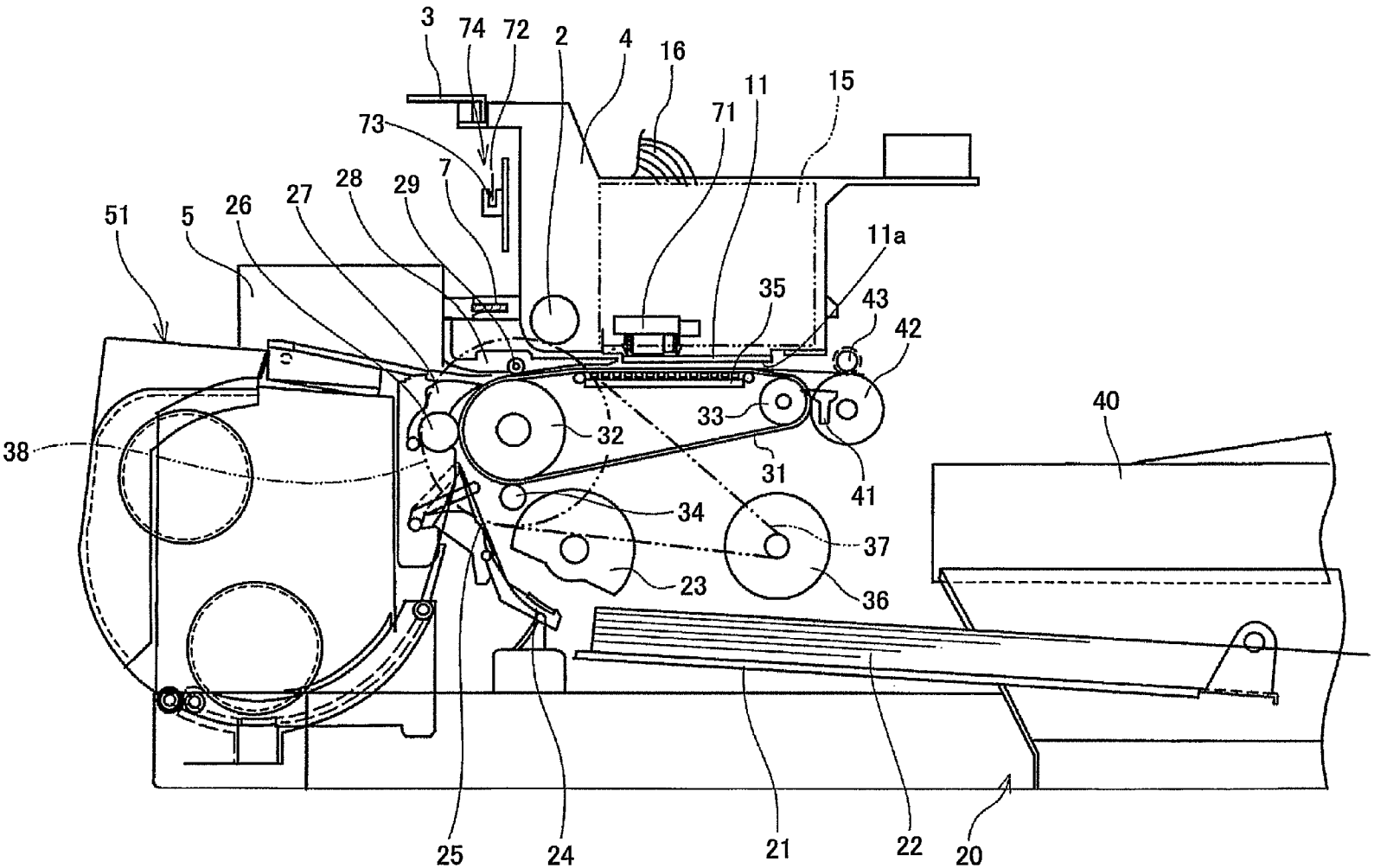
FIG. 8 is a diagram showing a mechanical configuration of an imaging apparatus according to an embodiment of the present invention in side view.
Figure 9:
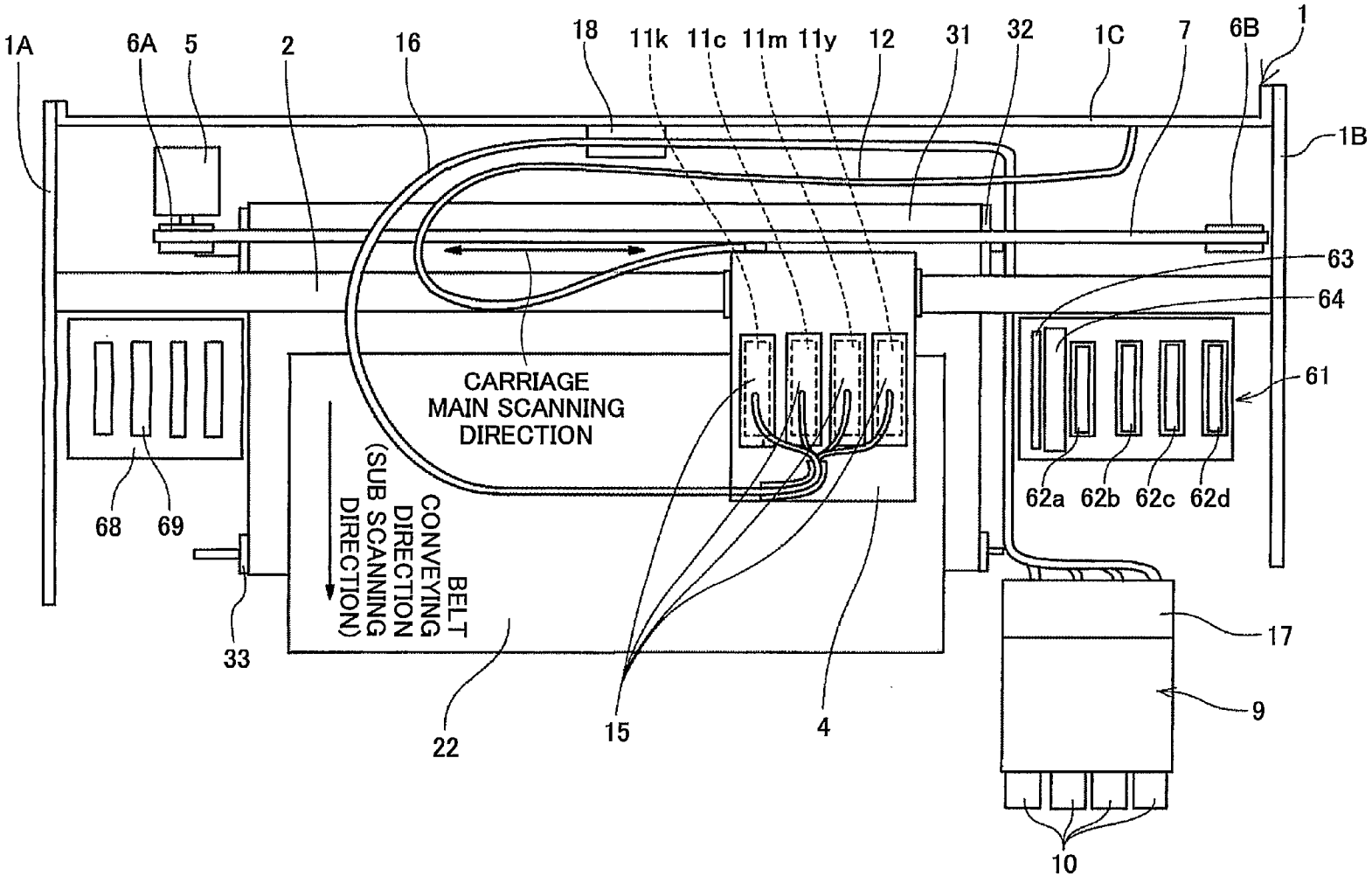
FIG. 9 is a diagram illustrating the mechanical configuration of the imaging apparatus according to the present embodiment in plan view.

FIGS. 8 and 9 are diagrams illustrating a configuration of an imaging apparatus according to one embodiment of the present invention. It is noted that FIG. 8 is a side view and FIG. 9 is a plan view of the imaging apparatus of the present embodiment.

The imaging apparatus of the present embodiment includes a frame 1 having side plates 1A and 1B (see FIG. 9), a guide rod 2 that is arranged across the frame 1 to be supported by the side plates 1A and 1B, a stay 3 (see FIG. 8), a carriage 4 that is slidably supported by the guide rod 2 and the stay 3, a main scanning motor 5, a drive pulley 6A, a driven pulley 6B (see FIG. 9), and a timing belt 7 that is arranged around the drive pulley 6A and the driven pulley 6B and is driven by the main scanning motor 5 so as to move the carriage 4 in the directions indicated by the arrow shown in FIG. 9 (main scanning direction).

The carriage 4 includes a recording head 11 having four liquid discharge heads 11*k*, 11*c*, 11*m*, and 11*y* (see FIG. 9) that are configured to discharge inks in colors black (Bk), cyan (C), magenta (M), and yellow (Y), respectively. Each of the liquid discharge heads 11*k*, 11*c*, 11*m*, and 11*y* has a nozzle surface 11*a* (see FIG. 8) on which plural nozzle arrays each having plural ink discharging outlets (nozzles) aligned in a direction perpendicular to the main scanning direction (sub scanning direction) are formed, the nozzle surface 11*a* being positioned so that the ink discharging direction of the nozzles is directed downward. It is noted that in the illustrated example, plural independent liquid discharge heads 11*k*, 11*c*, 11*m*, and 11*y* are used. However, it is noted that the present invention is not limited to such an example, and one or more recording heads having plural nozzle arrays for discharging droplets of recording liquid of different colors may be used. Also, it is noted that the number of colors used and their arrangement order is not limited to the illustrated example.

Figure 4:
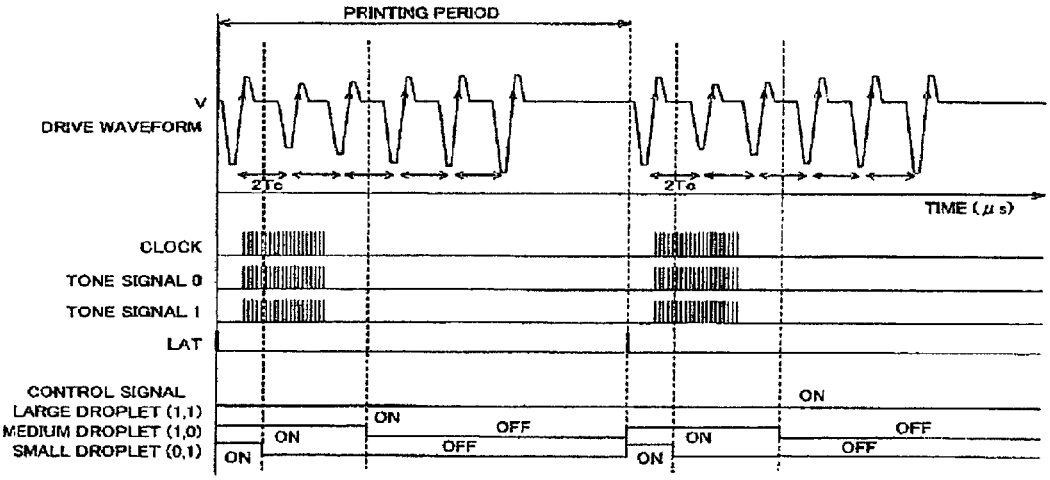
Prior Art FIG.4
FIG. 4 is a diagram illustrating a data transmitting method involving transmitting tone data once every printing period using a drive waveform having six drive pulses.
Figure 5A:
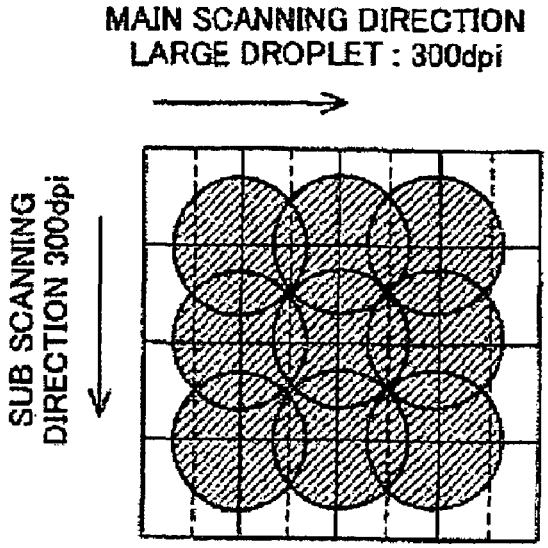
Prior Art FIG.5A
FIGS. 5A and 5B are diagrams illustrating different dot sizes and respective arrangements thereof according to the printing resolutions in the main scanning direction and the sub scanning direction.
Figure 5B:
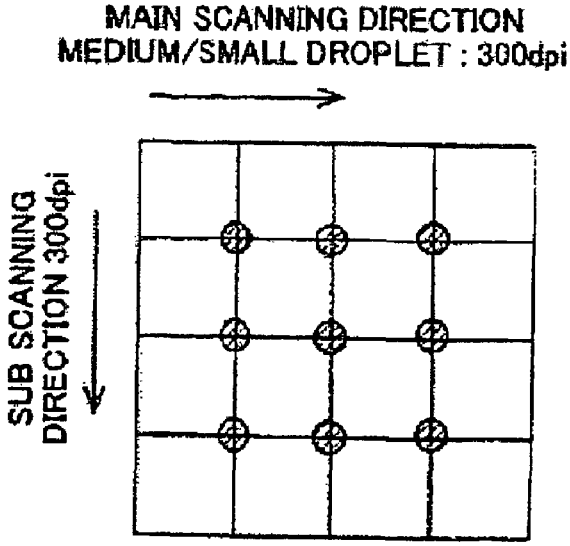
Prior Art FIG.5B
Figure 10:
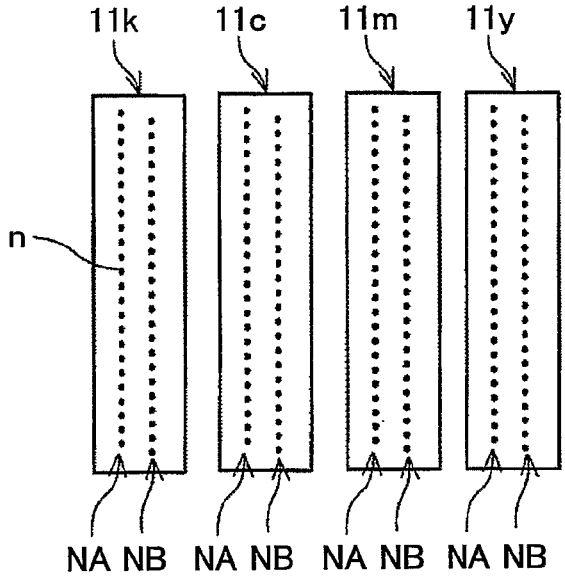
FIG. 10 is a diagram illustrating an exemplary configuration of a recording head of the imaging apparatus according to the present embodiment.
Figure 11:
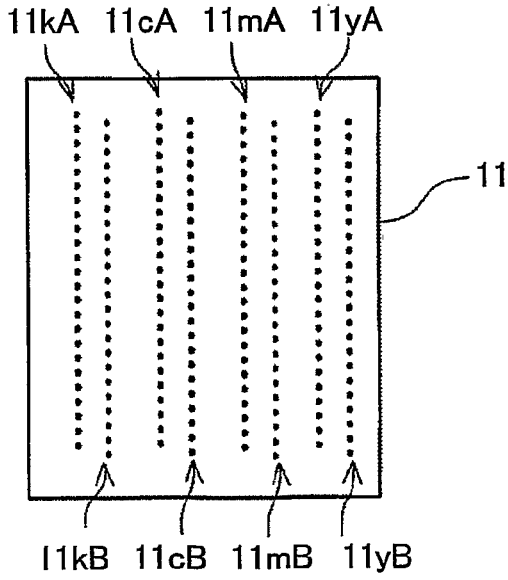
FIG. 11 is a diagram illustrating another exemplary configuration of the recording head of the imaging apparatus of the present embodiment.

As is described above, the recording head 11 of the present embodiment includes four independent liquid discharge heads 11*k*, 11*c*, 11*m*, and 11*y* that are configured to discharge inks of different colors. Further, as is shown in FIG. 10, each of the liquid discharge heads 11*k*, 11*c*, 11*m*, and 11*y* includes two nozzle arrays (referred to as nozzle NA and nozzle NB) each having plural nozzles n for discharging liquid droplets arranged in a line. However, the present invention it not limited to such an example, and as is illustrated in FIG. 4, one recording head 11 may be arranged to include nozzle array pairs 11*k*A and 11*k*B, 11*c*A and 11*c*B, 11*m*A and 11*m*B, and 11*y*A and 11*y*B that are configured to discharge liquid droplets in the respective recording colors. In another example, a recording head that has one or more nozzle arrays configured to discharge black ink, and another recording head for discharging color ink that has one or more nozzle arrays for each color may be used.

It is noted that the recording head 11 may be an inkjet head that includes a piezoelectric actuator that is configured to generate pressure for discharging liquid droplets, for example.

Also, it is noted that the recording head 11 includes a driver IC, and is connected to a control unit (not shown) via a harness (flexible printer cable: FPC) 12 (see FIG. 9).

The carriage 4 includes a sub tank 15 for each color configured to supply the corresponding color ink to the recording head 11. The corresponding color ink is supplied to each sub tank 15 from a corresponding cartridge 10 that is arranged in a cartridge loading unit 9 via a corresponding ink supply tube 16. The cartridge loading unit 9 includes a supply pump unit 17 for transferring ink within the ink cartridge 10. The ink supply tube 16 has an intermediate section that is engaged with a back plate 1C by an engaging member 18 (see FIG. 9).

The imaging apparatus of the present embodiment has a paper feeding part including a paper feeding tray 20, a paper stacking plate 21, a paper feeding roller 23 for separately feeding each sheet of paper 22 stacked on the paper stacking plate 21, and a separating pad 24 made of a material having a large friction coefficient that is arranged opposite the paper feeding roller 23 and is applied a force towards the paper feeding roller 23.

Also, the imaging apparatus of the present embodiment has a conveying part including a guide member 25 for guiding the paper 22 fed from the paper feeding part to convey the paper to a position beneath the recording head 11, a counter roller 26, a conveying guide member 27, a holding member 28 having a tip pressurizing collar 29, and a conveying belt 31 configured to have the paper 22 fed from the paper feeding part statically adhered thereto for conveying the paper 22 to a position opposing the recording head 11 (see FIG. 8).

The conveying belt 31 is a continuous belt that is arranged around a conveying roller 32 and a tension roller 33 and is configured to rotate in a belt conveying direction (sub scanning direction). The conveying belt 31 is charged by a charge roller 34 while rotating in the sub scanning direction.

It is noted that the conveying belt 31 may have a single layer structure or a multi-layer structure (with at least two layers). In a case where the conveying belt 31 has a single layer structure, the conveying belt 31 comes into contact with the paper 22 and the charge roller 34, and thereby the entire belt layer is preferably made of an insulating material. In a case where the conveying belt 31 has a multi-layer structure, the layer that comes into contact with the paper 22 and the charge roller 34 is preferably made of an insulating material whereas the layer(s) that does not come into contact with the paper 22 and the charge roller 34 is preferably made of conductive material.

The insulating material of the conveying belt 31 having a single layer structure or the insulating material of the insulating layer of the conveying belt 31 having a multi-layer structure may be resin such as PET, PEI, PVDF, PC, ETFE, PTFE, or elastomer material that does not include conduction control material, for example. The volume resistance of the insulating material is preferably at least $10^{12}$ Ωcm and more preferably $10^{15}$ Ωcm. Also, the conductive material of the conductive layer of the conveying belt 31 having a multi-layer structure may be a material made of resin or elastomer as is described above with carbon added thereto to realize a volume resistance preferably within a range of $10^5$ Ωcm to $10^7$ Ωcm.

The charge roller 34 comes into contact with the insulating layer of the conveying belt 31 (in the case where the conveying belt 31 has a multi-layer structure), and is arranged to be driven by the rotating movement of the conveying belt 31. A pressurizing force is applied to both ends of the rotational axis of the charge roller 34. The charge roller 34 is preferably made of a conductive material having a volume resistance of $10^6$-$10^9$ Ωcm/□. An AC bias (high voltage) for positive and negative electrodes at 2 kV, for example, is applied to the charge roller 34 from an AC bias supplying unit (high voltage power source) as is described in detail below. The AC bias may be a sine wave or a triangular wave, for example, but is preferably a square wave.

As is shown in FIG. 8, a guide member 35 is arranged at the rear side of the conveying belt 31 at a position corresponding to the printing region for the recording head 11. The upper surface of the guide member 35 is arranged to be raised towards the recording head 11 with respect to the tangential line formed by the two rollers (conveying roller 32 and tension roller 33) supporting the conveying belt 31 so as to maintain the precise planarity of the conveying belt 31.

The conveying belt 31 is rotated in the belt conveying direction (sub scanning direction) as is shown in FIG. 9 by the rotation of the conveying roller 32 that is driven to rotate by a sub scanning motor 36, a drive belt 37, and a timing belt 38 (see FIG. 8). It is noted that an encoder wheel (not shown) having slits formed thereon is attached to the rotational axis of the conveying roller 32, and a transparent photo sensor (not shown) is arranged to detect the slit of the encoder wheel, the encoder wheel and the photo sensor making up a wheel encoder.

Also, the imaging apparatus of the present embodiment includes a separating pick 41, a delivery roller 42, and a delivery collar 43 as a delivery unit for delivering paper 22 having an image recorded by the recording head 11 to a delivery tray 40.

Further, a dual side printing unit 51 is detachably arranged at the rear side of the frame 1 (see FIG. 8). The dual side printing unit 51 is configured to receive paper 22 that is carried in a reverse direction through reverse rotation of the conveying belt 31, and turn the received paper 22 over to the other side to feed the paper 22 once more between the counter roller 26 and the conveying belt 31. Also, a manual paper feed tray 52 is arranged at the upper side of the dual side printing unit 51.

It is noted that a maintenance restoration mechanism 61 for maintaining and restoring the nozzles of the recording head 11 is arranged at a position corresponding to a non-printing region on one side with respect to the scanning direction of the carriage 4. The maintenance restoration mechanism 61 includes cap members 62*a*-62*d* (also referred to as 'cap 62' hereinafter) for capping the nozzle surfaces 11*a* of the recording head 11; a wiper blade 63 corresponding to a blade member for wiping the nozzle surfaces 11*a*; and an air discharge receiver 64 configured to receive liquid droplets discharged through air discharge which is unrelated to image recording and is performed in order to discharge thickened recording liquid, for example. In the present example, cap 62A corresponds to a suction and moisture retention cap, and the caps 62*b*-62*d* correspond to moisture retention caps.

Also, an air discharge receiver 68 for receiving liquid droplets discharged through air discharge which is unrelated to image recording and is performed in order to discharge recording liquid that is thickened during recording, for example, is arranged at a position corresponding to a non-printing region on the other side with respect to the scanning direction of the carriage 4. The air discharge receiver 68 has openings 69 extending in the alignment direction of the nozzle array of the recording head 11, for example (see FIG. 9).

As is shown in FIG. 8, the carriage 4 has a density sensor 71 including an infrared sensor (the type of sensor is not limited to an infrared sensor), for example, as detecting means for detecting the existence of paper 22. When the carriage 4 is positioned at a home position, the density sensor 71 is arranged to be positioned at the recording region (imaging region) side (i.e., conveying belt 31 side) with respect to the carriage scanning direction and upstream of the recording head 11 with respect to the paper conveying direction.

It is noted that an encoder scale 72 having slits formed thereon is arranged at the front side of the carriage 4 along the main scanning direction, and an encoder sensor 73 including a transparent sensor configured to detect the slit of the encoder scale 72 is also arranged at the front side of the carriage 4. The encoder scale 72 and the encoder sensor 73 realize a linear encoder 74 for detecting the main scanning position of the carriage 4.

Figure 12:
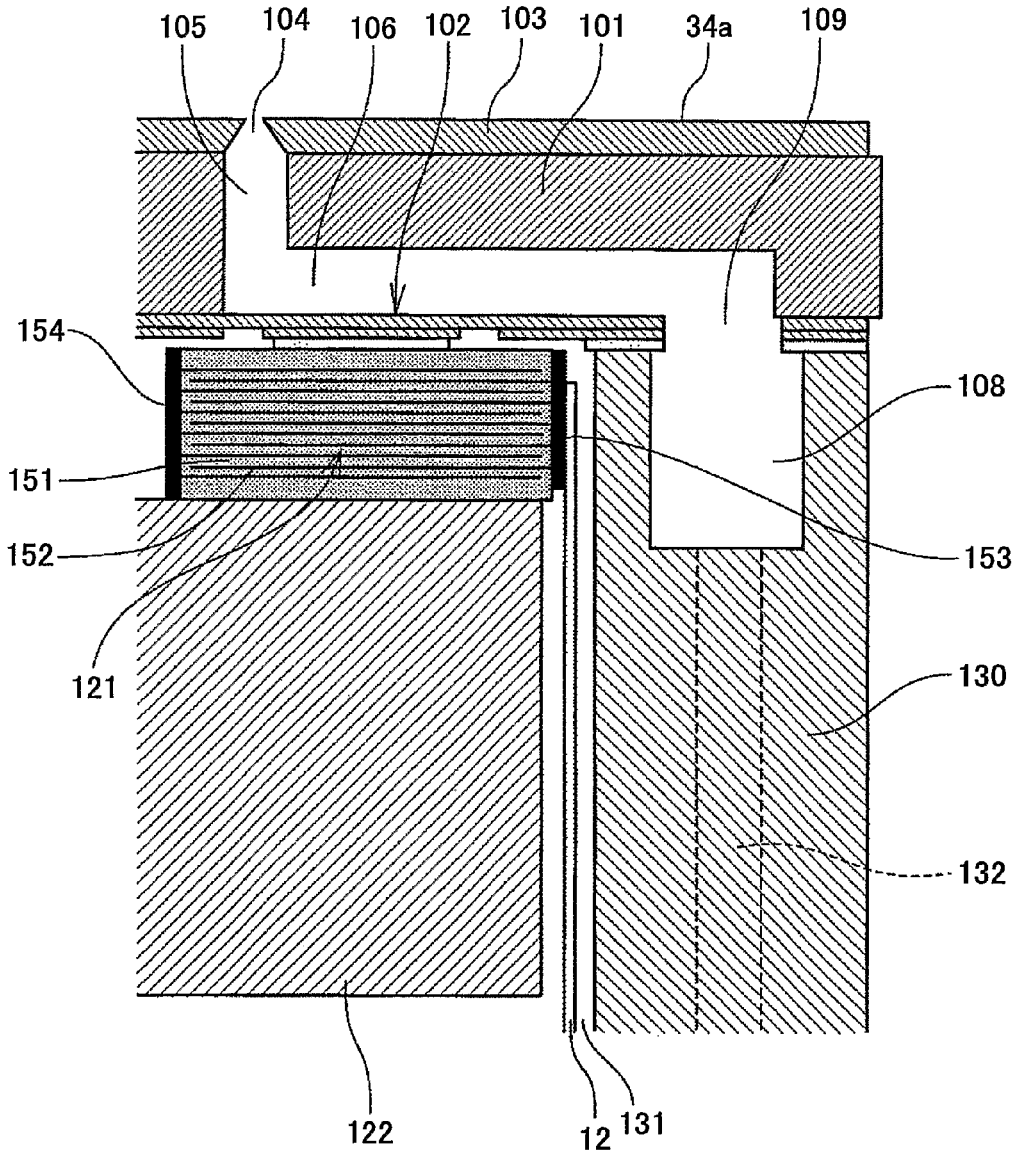
FIG. 12 is a diagram illustrating an exemplary configuration of a liquid discharge head included in the recording head of the imaging apparatus of the present embodiment in cross-sectional view across a long side direction of a liquid chamber of the liquid discharge head.
Figure 13:
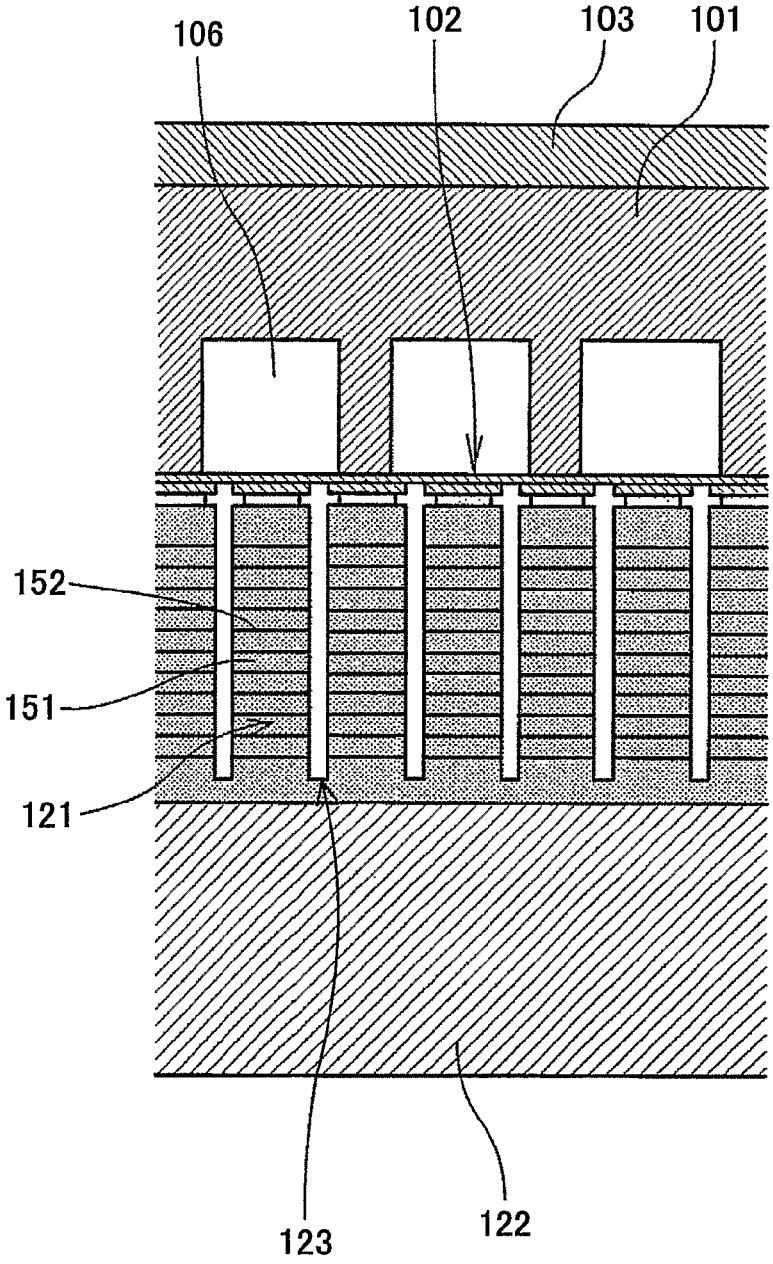
FIG. 13 is a diagram illustrating an exemplary configuration of the liquid discharge head of FIG. 12 in cross-sectional view across a short side direction of the liquid chamber of the liquid discharge head.

FIGS. 12 and 13 are diagrams illustrating an exemplary configuration of the recording head of the imaging apparatus according to the present embodiment. It is noted that FIG. 12 is a cross-sectional view of a liquid discharge head cut across the direction of a longer side of a liquid chamber, and FIG. 13 is a cross-sectional view of the liquid discharge head cut across the direction of a shorter side of the liquid chamber (nozzle alignment direction).

The illustrated liquid discharge head includes a flow path plate 101 that is created by performing anisotropic etching on a single crystal silicon substrate, for example; an vibrating plate 102 that is created through nickel electrotyping, for example, and is adhered to the lower surface of the flow path plate 101; and a nozzle plate 103 that is adhered to the upper surface of the flow path plate 101. The nozzle plate 103, the flow path plate 101, and the vibrating plate 102 are deposited to form a nozzle connecting flow path 105 connected to a nozzle 104 that discharges liquid droplets (ink droplets), a liquid chamber 106, and an ink supply opening 109 connected to a common liquid chamber 108 for supplying ink to the liquid chamber 106, for example.

Also, the illustrated liquid discharge head includes two rows of deposited piezoelectric elements 121 (only one row is shown in the FIG. 12) as an electromechanical conversion element corresponding to pressure generating means (actuator) for deforming the vibrating plate 102 and applying pressure to ink within the liquid chamber 106, and a base substrate 122 that fixes the piezoelectric elements 121. It is noted that column elements 123 are arranged between the piezoelectric elements as is shown in FIG. 13. The column elements 123 may be created simultaneously with the piezoelectric elements 121 through divisional processing. However, a drive voltage is not applied to the column elements 123.

The piezoelectric element 121 if connected to a cable 12 (see FIG. 12) that includes a drive circuit (not shown).

The peripheral portion of the vibrating plate 102 is connected to a frame member 130, and the frame member 130 realizes a through hole portion 131, a concave portion corresponding to the common liquid chamber 108, and an ink supply hole 132 for supplying ink to the common liquid chamber 108 from an external unit. The frame member 130 may be made using thermally cured resin such as epoxy resin or through injection molding using polyphenylene sulfide, for example.

The flow path plate 101 may be formed by performing anisotropic etching on a single crystal silicon substrate with (110) crystal orientation using alkaline etching liquid such as a potassium hydroxide solution, for example, to create a concave portion and a hole portion that form the nozzle connecting flow path 105 and the liquid chamber 106, for example. However, it is noted that the present invention is not limited to such an example, and in other embodiments, a stainless substrate or a photoconductive resin substrate may be used instead of a single crystal silicon substrate to realize the flow path plate 101.

The vibrating plate 102 may be created by performing an electroforming (electrotyping) process on a nickel plate, for example. However, in other examples, some other metal plate or a metal and resin combined plate may be used. It is noted that the piezoelectric elements 121 and the column members 123 are adhered to the vibrating plate 102 with adhesive, and the frame member 130 is adhered to the peripheral portion of the vibrating plate 102 with adhesive.

The nozzle plate 103 forms a nozzle 104 having a diameter of 10-30 μm corresponding to each liquid chamber 106, and is adhered to the flow path plate 101 with adhesive. The nozzle plate 103 is formed by depositing one or more layers as is necessary or desired on the surface of a nozzle forming member made of metal and arranging the uppermost layer to be a water repellant layer. It is noted that the upper surface of the nozzle plate 103 may correspond to the nozzle surface 11*a* as is described above.

The piezoelectric element 121 is formed by alternatingly depositing a piezoelectric material 151 and an internal electrode 152 (corresponding to a PZT in the present example). It is noted that an individual electrode 153 and a common electrode 154 are connected to each of the internal electrodes 152 arranged at alternating ends of the piezoelectric element 121. In the illustrated example, the piezoelectric element 121 is configured to apply pressure to ink contained within a corresponding pressurizing liquid chamber 106 using displacement in the piezoelectric constant d33 direction; however, the present invention is not limited to such an example, and piezoelectric element 121 is configured to apply pressure to ink contained within a corresponding pressurizing liquid chamber 106 using the displacement in the piezoelectric constant d31 direction as well. Also, in another example, one row of the piezoelectric element 121 may be arranged on one substrate 122.

In the illustrated liquid discharge head, for example, by decreasing the voltage applied to the piezoelectric element 121 with respect to a reference voltage, the piezoelectric element 121 may contract and the vibrating plate 102 may be lowered so that the volume of the liquid chamber 106 may expand to induce ink to flow into the liquid chamber 106. Then, the voltage applied to the piezoelectric element 121 may be increased so that the piezoelectric element 121 may expand in the depositing direction to cause deformation of the vibrating plate 102 in the nozzle 104 direction and contraction of the liquid chamber 106. In this way, the recording liquid contained within the liquid chamber 106 may be pressurized, and one or more droplets of the recording liquid may be discharged from the nozzle 104.

Then, by setting the voltage applied to the piezoelectric element 121 back to the reference voltage, the vibrating plate 102 may be restored to its initial position and the liquid chamber 106 may expand so that a negative pressure is generated. As a result, recording liquid may be supplied to the liquid chamber 106 from the common liquid chamber 108. After the vibration of the meniscus surface of the nozzle attenuates and stabilizes, operations may be started for realizing a next liquid droplet discharge.

It is noted that the head drive method for driving the liquid discharge head is not limited to the above-described example (i.e., pull-push actuation), and the pull actuation mode or the push actuation mode may alternatively be used, for example, depending on the manner in which the drive waveform is applied.

In the imaging apparatus according to the present embodiment, each sheet of paper 22 is separately fed from the paper feeding part to be guided upward by the guide 25 in an approximately vertical direction, inserted between the conveying belt 31 and the counter roller 26, and conveyed further so that the tip the fed paper 22 is guided by the conveying guide member 27 and pushed towards the conveying belt by the tip pressurizing collar 29 to thereby change the conveying direction of the paper 22 by approximately 90 degrees.

It is noted that positive and negative outputs from the AC bias supply unit (described in detail below) are alternatingly applied to the charge roller 34; that is, an alternating voltage is applied to the charge roller 34. In turn, an alternating charge voltage pattern is formed on the conveying belt 31; that is, positive and negative voltage charged strips having a predetermined width are alternatingly arranged in the sub scanning direction corresponding to the rotation direction of the conveying belt 31. When paper 22 is placed on the conveying belt 31 that is alternatingly charged with the positive and negative voltages, the paper 22 may be adhered to the conveying belt 31 through electrostatic suction, and in this way, the paper 22 may be conveyed in the sub scanning direction by the rotating movement of the conveying belt 31.

According to the present embodiment, the recording head 11 may be driven according to an image signal while the carriage 4 is moved so that ink droplets may be discharged onto the paper 22, which is maintained still, to thereby record one line image on the paper 22. Then, the paper 22 is moved in the sub scanning direction by a predetermined distance after which recording of the next line image may be performed. Then, when a recording end signal or a signal indicating that the rear end of the paper 22 has reached the recording region is received, the recording operation is ended and the paper 22 is delivered to the delivery tray 40.

In the case of realizing dual side printing, when image recording of the front side of the paper 22 is completed, the conveying belt 31 is rotated in a reverse direction so that the recorded paper 22 may be sent to the dual side printing unit 51 at which the paper 22 is turned over (so that the back side of the paper 22 becomes the printing surface), and the paper 22 may be inserted once more between the counter roller 26 and the conveying belt 31 so that image recording through timing control may be performed on the back side of the paper 22 in the manner described above after which the paper 22 may be delivered to the delivery tray 40.

Figure 14:
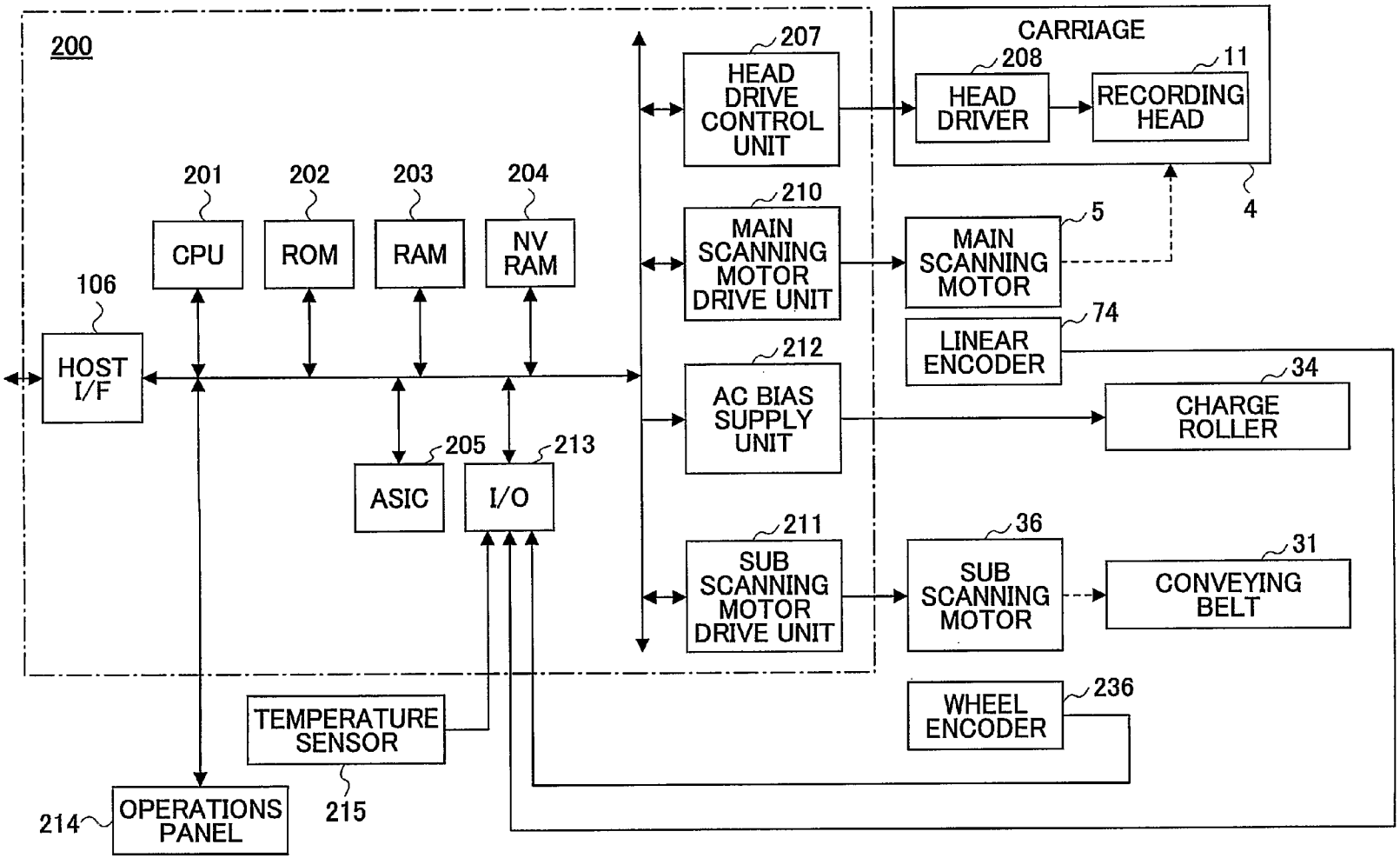
FIG. 14 is a block diagram illustrating a configuration of a control part of the imaging apparatus of the present embodiment.

FIG. 14 is a block diagram showing an exemplary configuration of a control part of the imaging apparatus according to the present embodiment.

The control part 200 shown in FIG. 14 includes a CPU 201 that realizes overall control of the imaging apparatus, a ROM 202 that stores programs to be executed by the CPU 201 and other fixed data, a RAM 203 that temporarily stores data such as image data, a rewritable nonvolatile memory 204 for retaining data even when the power of the imaging apparatus is turned off, and an ASIC 205 that performs image processing such as sorting and processing of input/output signal for controlling the overall operation of the imaging apparatus, for example.

The control part 200 also includes a host interface (I/F) 206 for realizing transmission/reception of data and signals with a host; a head drive control unit 207 that includes data transmission means and realizes drive control of the recording head 11; a head driver (driver IC) 208 corresponding to a head drive device for driving the recording head 11 arranged at the carriage 4; a main scanning motor drive unit 210 for driving the main scanning motor 5; a sub scanning motor drive unit 211 for driving the sub scanning drive motor 36; an AC bias supply unit 212 that supplies an AC bias to the charge roller 34; an I/O 213 for inputting detection pulses from the linear encoder 74 and the wheel encoder 236, detection signals from a temperature sensor 215 that detects the environmental temperature, and detection signals from other various sensors. Also, it is noted that the control part 200 is connected to an operations panel 214 that is configured to input and display relevant information for the imaging apparatus.

In the present embodiment, the control part 200 is configured to receive data such as print data from a host such as an information processing apparatus (e.g., personal computer), an image reading apparatus (e.g., image scanner), or an image capturing apparatus (e.g., digital camera) at the I/F 206 via a cable or a network, for example.

The control part 200 is configured to read and analyze print data stored in a reception buffer included in the I/F 206, execute required image processes such as data sorting, for example, and transmit the resulting image data from the head drive control unit 207 to the head driver 208. It is noted that dot pattern data for realizing image output may be generated based on font data stored in the ROM 202, for example, or image data may arranged to be developed into bitmap data at the printer driver of the host and the imaging apparatus may be arranged to receive the bitmap data.

The head drive control unit 207 is configured to serially transmit the image data as is described above, and output signals such as a transmission clock, a latch signal, and a control signal for transmitting the image data and making determinations pertaining to transmission to the head driver 208. The head drive control unit 207 also has a drive waveform generating unit including a D/A converter for converting the pattern data of drive pulses stored in the ROM 202 to be read by the CPU 201 and an amplifier, for example, and is configured to output a drive waveform made up of one or more drive pulses (drive signals) to the head driver 208.

The head driver 208 is configured to selectively apply the one or more drive pulses making up the drive waveform transmitted from the head drive control unit 207 to the actuator means (e.g., piezoelectric element 121 in the example described above) of the recording head 11 to thereby drive the recording head 11, the selective application of the drive pulses being based on the serially input image data corresponding to one line image to be recorded by the recording head 11.

The main scanning motor drive unit 210 is configured to calculate a control value based on a speed detection value obtained by sampling a target value supplied by the CPU 201 and the detection pulse from the linear encoder 74, and drive the main scanning motor 5 via an internal motor driver.

Similarly, the sub scanning motor drive control unit 211 is configured to calculate a control value based on a speed detection value obtained by sampling a target value supplied by the CPU 201 and the detection pulse from the wheel encoder 236, and drive the sub scanning motor 36 via an internal motor driver.

Figure 15:
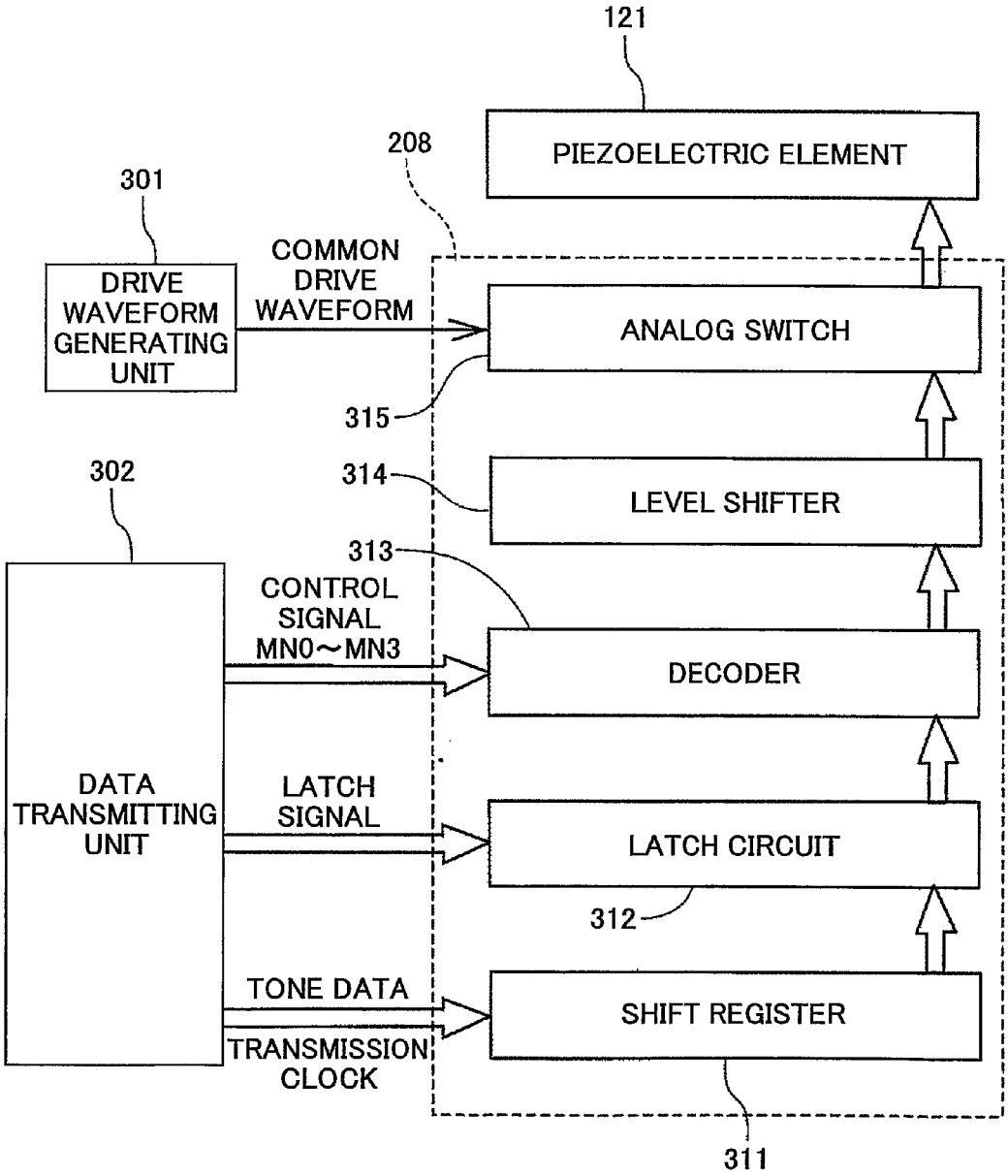
FIG. 15 is a block diagram illustrating configurations of a head drive control unit and a head driver of the control part of FIG. 14 according to one example.

FIG. 15 is a block diagram showing exemplary configurations of the head drive control unit 207 and the head driver 208 of the control part 200 according to one embodiment of the present invention.

According to the present embodiment, the head drive control unit 207 includes a drive waveform generating unit 301 that is configured to generate and output a drive waveform (common drive waveform) including plural drive pulses (drive signals) within one printing period, and a data transmitting unit 302 that is configured to output two bit image data (tone signal 0, 1) according to a print image, a clock signal, a latch signal (LAT), and control signals M0-M3.

The control signals correspond to two bit signals for designating the on/off state of an analog switch 315 of the head driver 208 (described in detail below) with respect to each liquid droplet to be discharged. The on/off state of the control signals may be changed according to whether a drive pulse within a printing period of the common drive waveform is to be selected. Specifically, the control signals may be set to high level H (on) to select a corresponding drive pulse, and set to low level L (off) when the corresponding drive pulse is not selected.

The head driver 208 includes a shift register 311 for inputting a transmission clock (shift clock) supplied from the data transmitting unit 302 and serial image data (tone data: 2 bits/CH), a latch circuit 312 for latching each registered value in the shift register 311 by a latch signal, a decoder 313 for decoding the tone data and the control signals MN0-MN3 and outputting the resulting data/signals, a level shifter 314 for converting a logic level voltage signal to a level operable for the analog switch 315, and the analog switch 315 that is switched on/off by the output of the decoder 313 that is supplied thereto via the level shifter 314.

The analog switch 315 is connected to the selection electrode (individual electrode) 154 of each piezoelectric element 121, and inputs the common drive voltage supplied from the drive waveform generating unit 301. Accordingly, when the analog switch 315 is switched on based on the decoded results of the serially transmitted image data (tone data) and the control signals MN0-MN3 obtained by the decoder 313, the corresponding drive signal (drive pulse) of the common drive waveform is passed (selected) to thereby be applied to the piezoelectric element 121.

In the following, a drive waveform that is used in a first embodiment of the present invention is described with reference to FIG. 16.

Figure 16:
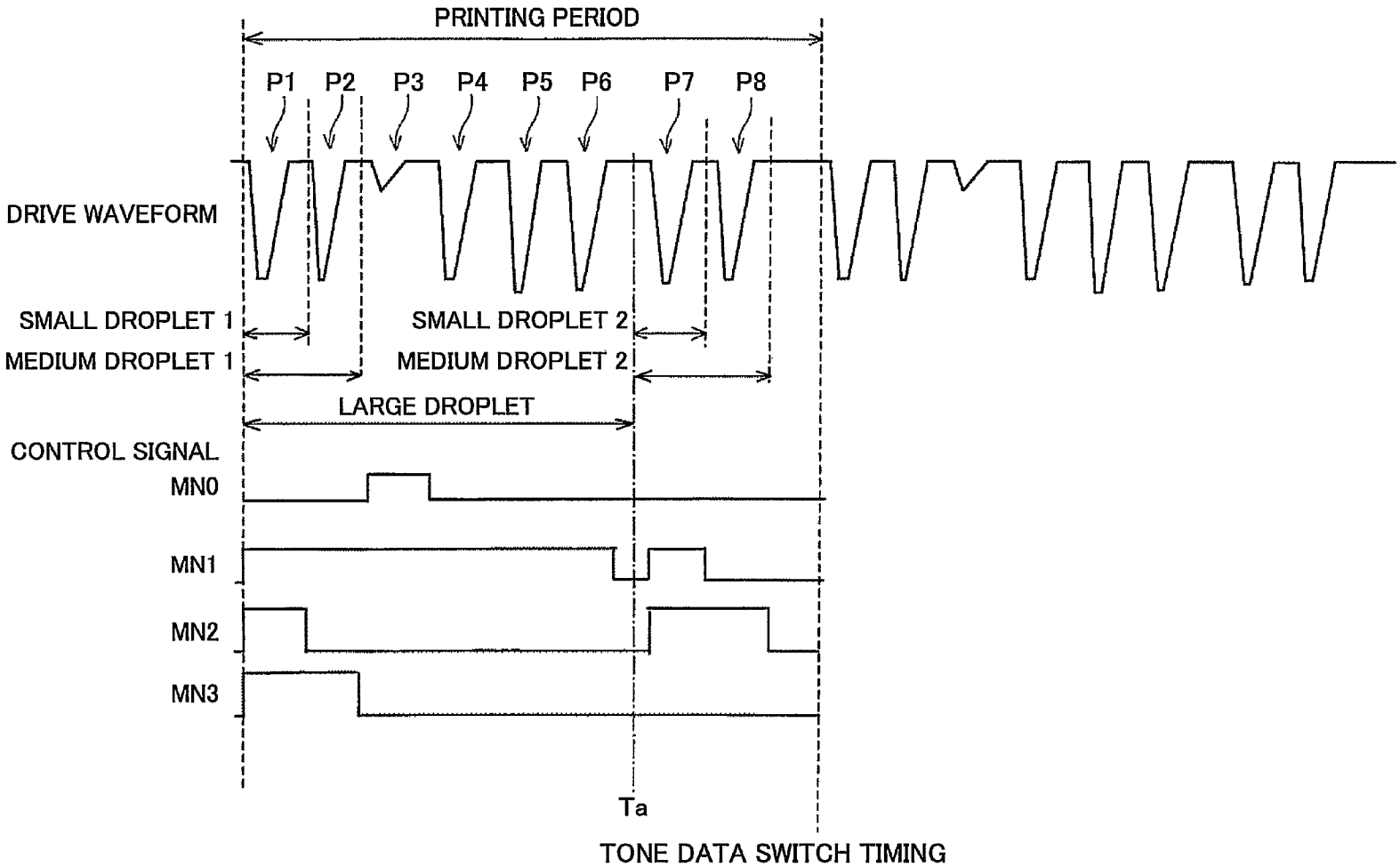
FIG. 16 is a diagram illustrating a drive waveform used in a first embodiment of the present invention.

The drive waveform shown in FIG. 16 includes eight drive pulses (drive signals) P1-P8 within one printing period. The drive pulses P1-P6 are used (selected) to form one large dot with one large droplet within one printing period; the drive pulses P1, P2, P7, and P8 are used (selected) to form two medium dots with two medium droplets; and the drive pulses P1 and P7 are used (selected) to form two small dots with two small droplets. It is noted that the drive pulse P3 corresponds to a subtle drive pulse that does not induce liquid droplet discharge (non-discharge pulse) and is used for vibrating the meniscus.

As can be appreciated from the above descriptions, the drive waveform according to the present embodiment enables one large dot to be formed by one large droplet, or two medium/small dots to be formed by two medium/small droplets within one printing period. The drive pulses P1 and P2 for forming a large dot with a large droplet is also used to form one medium (or small, in which case only the drive pulse P1 is used) dot with a medium (small) droplet. In the following, the small droplet discharged by the drive pulse P1 is referred to as 'small droplet 1'; the small droplet discharged by the drive pulse P7 is referred to as 'small droplet 2'; the medium droplet discharged by the drive pulses P1 and P2 is referred to as 'medium droplet 1'; and the medium droplet discharged by the drive pulses P7 and P8 is referred to as 'medium droplet 2'.

It is noted that the control signal MN0 shown in FIG. 16 corresponds to a signal for selecting the drive pulse P3; the control signal MN1 is for selecting the drive pulses P1-P6 for forming the large droplet (in which case five droplets are discharged since no droplet is discharge by the drive pulse P3) and the drive pulse P7 for forming the small droplet 2; the control signal MN2 is for selecting the drive pulse P1 for forming the small droplet 1 and the drive pulses P7 and P8 for forming the medium droplet 2; and the control signal MN3 is for selecting the drive pulses P1 and P2 for forming the medium droplet 1.

According to the present embodiment, tone data transmitted to the shift register 311 from the data transmitting unit 302 are switched at a timing Ta between the drive pulses P6 and P7 of the illustrated drive waveform. Also, with respect to the control signals MN1 and MN2, mode switching is realized at the timing Ta for switching from large droplet selection to small droplet selection, and from small droplet selection to medium droplet selection, respectively.

In the present embodiment, based on the tone data (2 bits/CH) supplied to the head driver 208 from the data transmitting unit 302, during the first half of a printing period before the timing Ta is reached, when the control signal M1 is selected, one large dot is formed by the large droplet; when the control signal M2 is selected, one small dot is formed by the small droplet 1; and when the control signal M3 is selected, one medium dot is formed by the medium droplet 1. Then, the tone data are switched at the timing Ta so that during the second half of the printing period after the timing Ta, when the control signal M1 is selected, one small dot is formed by the small droplet 2; and when the control signal M2 is selected, one medium dot is formed by the medium droplet 2.

Figure 17A:
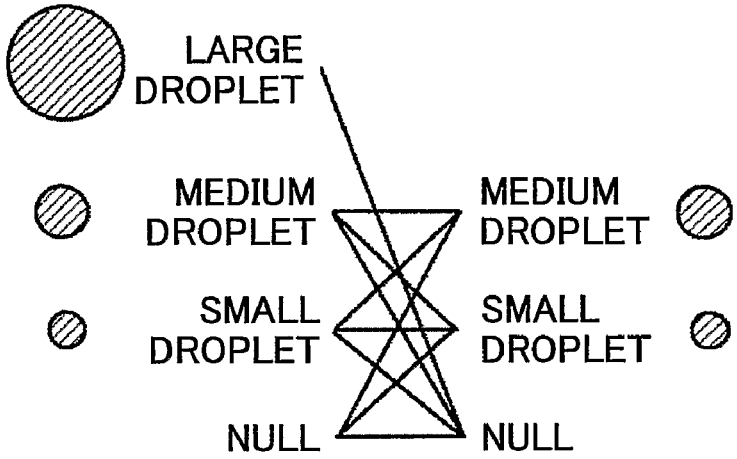
FIGS. 17A and 17B are diagrams illustrating exemplary dot combinations that may be realized in embodiments of the present invention.
Figure 17B:
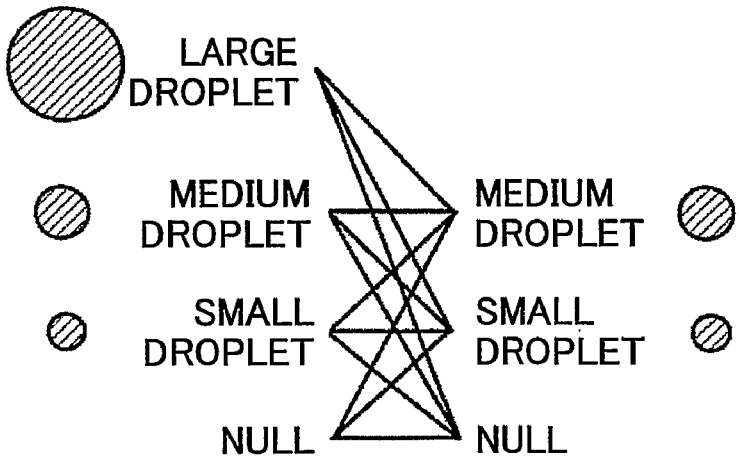

FIGS. 17A and 17B are diagrams illustrating exemplary dot combinations that may be realized according the present embodiment. As is shown in FIG. 17A, dots may be formed in combinations of LARGE-NULL, MEDIUM-MEDIUM/SMALL/NULL, SMALL-MEDIUM/SMALL/NULL, and NULL-MEDIUM/SMALL/NULL, for example. Also, as is shown in FIG. 17B, dots may be formed in combinations of LARGE-MEDIUM/SMALL/NULL, MEDIUM-MEDIUM/SMALL/NULL, SMALL-MEDIUM/SMALL/NULL, and NULL-MEDIUM/SMALL/NULL, for example.

Figure 18:
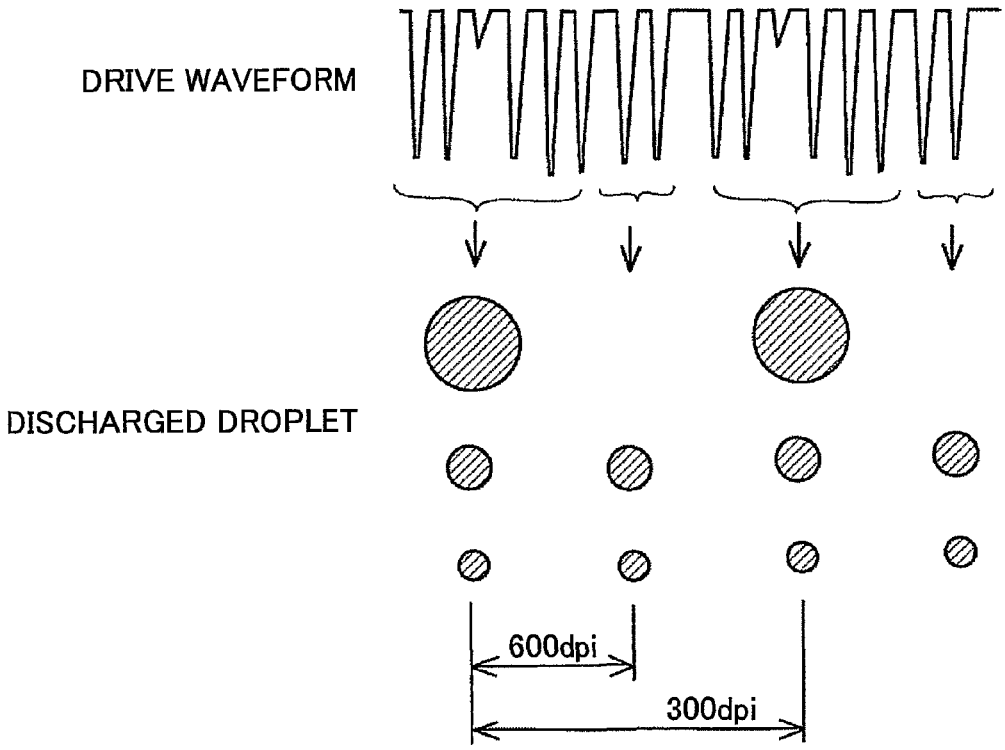
FIG. 18 is a diagram illustrating the discharging of droplets by the drive waveform of the first embodiment and dot formation positioning of the droplets.

FIG. 18 is a diagram illustrating an exemplary dot formation (printing) mode realized in the present embodiment. As is shown in this drawing, according to the present example, a large droplet is discharged to form a dot at a resolution of 300 dpi. Since a medium/small droplet may be discharged two times within one printing period, the medium/small droplet may be discharged to superficially realize dot formation at a resolution of 600 dpi. As can be appreciated from the above descriptions, in the present example, a printing mode is realized in which only the resolution in the main scanning direction for forming a dot with a large droplet corresponds to the resolution in the sub scanning direction.

By arranging a drive waveform to include a drive signal for forming a dot with a large droplet, and a drive signal for forming at least two dots with medium/small droplets within one printing period as is described above, even when a printing mode with differing resolutions in the main scanning direction and the sub scanning direction is implemented, the resolution in the main scanning direction in the case of discharging the large droplet is arranged to equal the resolution in the sub scanning direction. In this way, the time and voltage of the drive signal for discharging the large droplet may be adequately controlled, and a solid image may be adequately formed. In turn, high-speed printing and high-quality imaging may be realized at the same time.

It is noted that in a preferred embodiment, the large droplet is formed by inducing the merger of plural discharged droplets while the droplets are still in midair (before the droplets land on paper) so that the discharged droplets may land on the paper as one droplet. In this way, a high-quality image may be formed.

Figure 19:
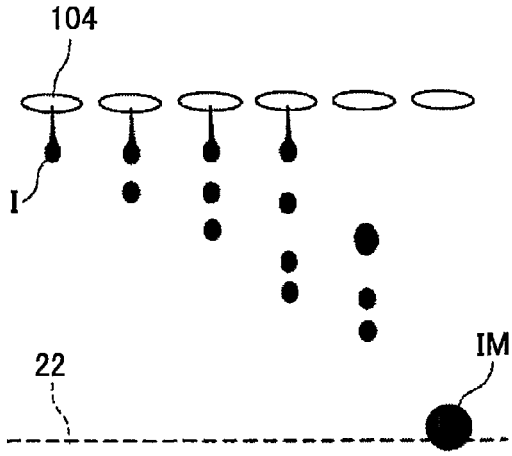
FIG. 19 is a diagram illustrating the merging of plural droplets.
Figure 20A:
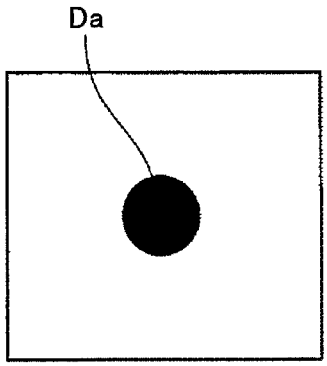
FIGS. 20A and 20B are diagrams respectively illustrating dot shapes realized in a case where droplets are merged and in a case where the droplets are not merged.
Figure 20B:
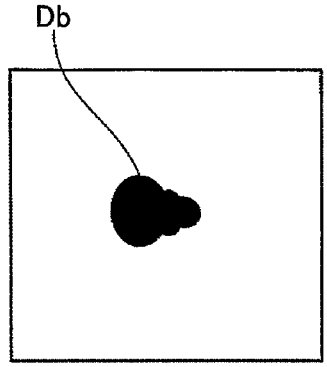

FIG. 19 is a diagram illustrating the merger of plural droplets discharged from a nozzle. As is shown in this drawing, plural droplets I are successively discharged from the nozzle 104, and the discharged droplets I are merged while they are in midair to form one droplet IM, which is arranged to land on the paper 22. In this way, a dot Da in good shape may be formed as is illustrated in FIG. 20A. On the other hand, when the droplets I discharged from the nozzle 104 are arranged to land on the paper 22 without being merged, variations may occur in the landing positions of the respective droplets I to thereby result in the formation of a dot Db as is shown in FIG. 20B, for example.

Also, in another preferred embodiment, at least four droplets are arranged to be discharged for forming a dot with a large droplet. In this way, a drive signal for forming a medium droplet or a small droplet may be easily included in the drive signal for forming the large droplet. In other words, the drive signal for forming a dot with a large droplet includes plural drive signals, and the plural drive signals include at least one of a drive signal for forming a dot with a medium droplet or a drive signal for forming a dot with a small droplet so that the overall time duration of the drive waveform may be reduced.

Also, by switching the tone data within one printing period, the medium/small droplets may be discharged a plural number of times within one printing period, and the number of tone levels may be increased. Further, by realizing a printing mode using a resolution in the main scanning direction that is higher than the resolution in the sub scanning direction but arranging the resolution in the main scanning direction for forming a dot with the large droplet to equal the resolution in the sub scanning direction in this mode, high-speed printing and high-quality imaging may be realized at the same time. It is noted that in this mode, an image may be formed through non-interlaced scanning, for example, in order to increase the imaging speed.

Also, it is noted that in the above descriptions, printing at a resolution of 600 dpi×300 dpi is illustrated as a representative example; however, the present invention is not limited to this resolution. Also, the drive waveform and the drive pulses included in the drive waveform are not limited to the example shown in FIG. 16.

Figure 21:
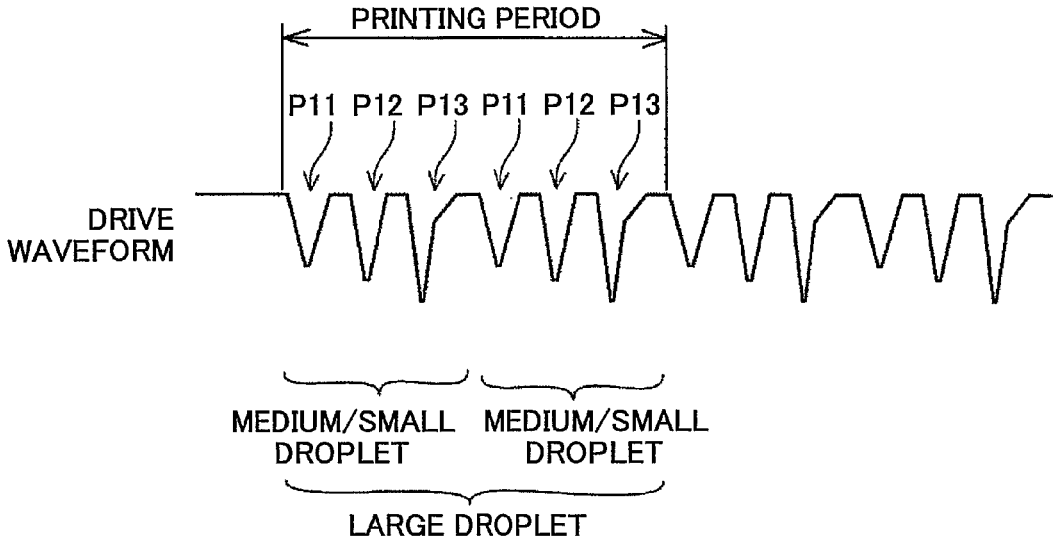
FIG. 21 is a diagram illustrating a drive waveform used in a second embodiment of the present invention.

In the following a drive waveform that is used in a second embodiment of the present invention is described with reference to FIG. 21.

According to the present embodiment, a waveform including plural drive pulses P11-P13 are repeated a plural number of times (two times in the illustrated example) within one printing period. The drive pulses P11-P13 correspond to drive signals for discharging a small droplet (e.g., with only drive pulse P11), and a medium droplet (e.g., with drive pulses P11-P13). In the present example, a drive signal for forming a large droplet may be realized by repeating the sequence of drive pulses P11-P13 two times.

In this case, based on tone data (2 bits/CH) transmitted from the data transmitting unit 302, dots may be formed in dot combinations of LARGE, MEDIUM-MEDIUM/SMALL/NULL, SMALL-MEDIUM/SMALL/NULL, and NULL-MEDIUM/SMALL/NULL. It is noted that the dot combinations as is illustrated in FIG. 17B may not be realized in the present embodiment since all the drive pulses included in the present waveform are used to form the large droplet.

Figure 22:
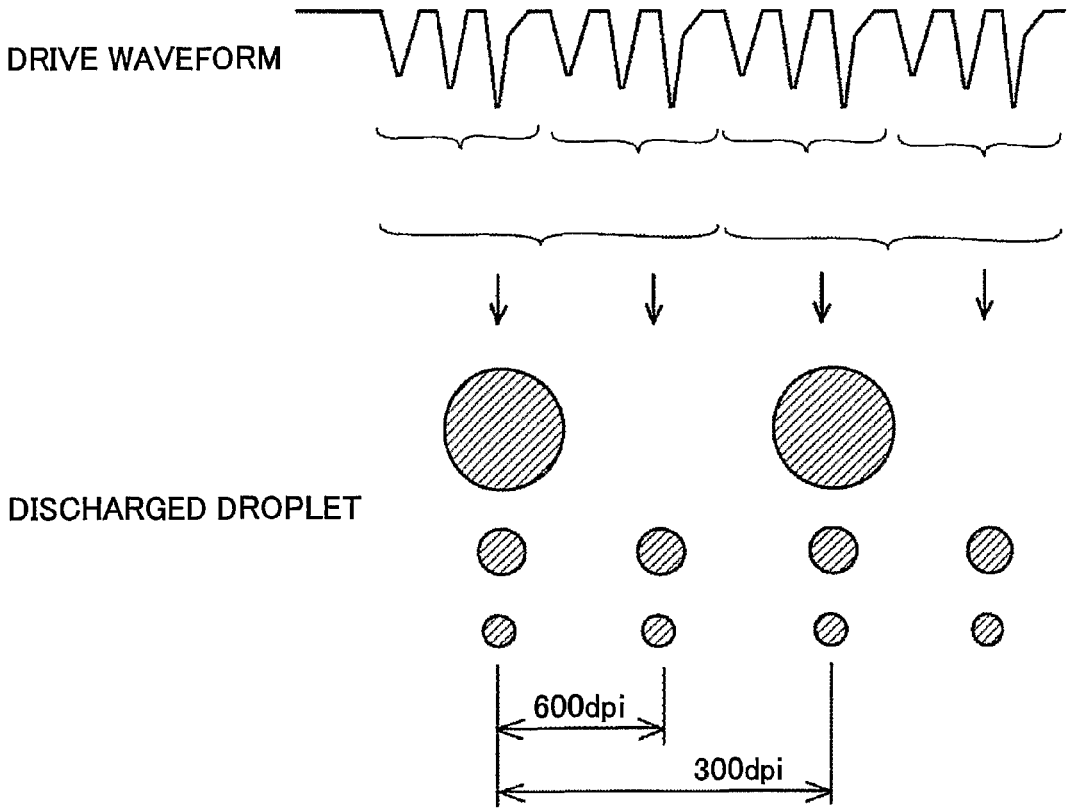
FIG. 22 is a diagram illustrating the discharging of droplets by the drive waveform of the second embodiment and dot formation positioning of the droplets.

FIG. 22 is a diagram illustrating a printing mode realized in the present embodiment. As is shown in this drawing, the large droplet is discharged to form a dot at a resolution of 300 dpi. The medium/small droplet may be discharged two times within one printing period, and thereby, dot formation at a resolution of 600 dpi may be superficially realized with the medium/small droplet. In other words, a printing mode is realized in which only the resolution in the main scanning direction for forming a dot with the large droplet is arranged to equal the resolution in the sub scanning direction so that high-speed printing and high-quality imaging may be realized at the same time.

It is noted that although dot formation at a resolution of 600 dpi×300 dpi is illustrated as a representative example in the above description, the resolution used in the present invention is not limited to this resolution. Also, the drive waveform and the drive signals (drive pulse waveform) included in the drive waveform are not limited to the illustrated example of FIG. 21.

In the following, a recording liquid (ink) used in an embodiment of the present invention is described.

The ink used in one preferred embodiment of the present invention includes pigment as a color material, and has a viscosity of at least 5 mPa·s at a temperature of 23° C. In this way, ink bleeding may be avoided and good color development and water resistance may be realized.

It is noted that the pigment used in the ink is not limited to a particular type of pigment. In the following, examples of pigments that may be used are listed.

For example, organic pigments such as azo pigment, phthalocyanine pigment, anthraquinone pigment, quinacridone pigment, dioxazine pigment, indigo pigment, thioindigo pigment, perylene pigment, isoindolinone pigment, aniline black, azomethine pigment, rhodamine lake B, carbon black, and combinations thereof may be used.

Also, inorganic pigments such as iron oxide pigment, titanium oxide pigment, calcium carbonate pigment, barium sulfate pigment, aluminum hydroxide pigment, barium yellow, Prussian blue, cadmium red, chromium yellow, metal powder, and combinations thereof may be used.

Further, it is noted that carbon black used as black pigment ink may correspond to furnace black or channel black, for example, and is preferably arranged to have a primary gain diameter of 15-40 mμ, a BET specific surface area of 50-300 $m^2/g$, a DBP oil absorption of 40-150 ml/100 g, a volatile matter content of 0.5-10%, and a pH value of 2-9. It is noted that examples of commercially available carbon black products meeting such conditions include No. 2300, No. 900, MCF88, No. 40, No. 52, MA7, MA8, and No. 2200B by Mitsubishi Kasei Corporation; RAVEN 1255 by Columbia Carbon Company; REGAL 400R, REGAL 660R, and MOGUL L by Cabot Corporation; and Color Black S150, Printex 35, and Printex U by Degussa.

Figure 23:
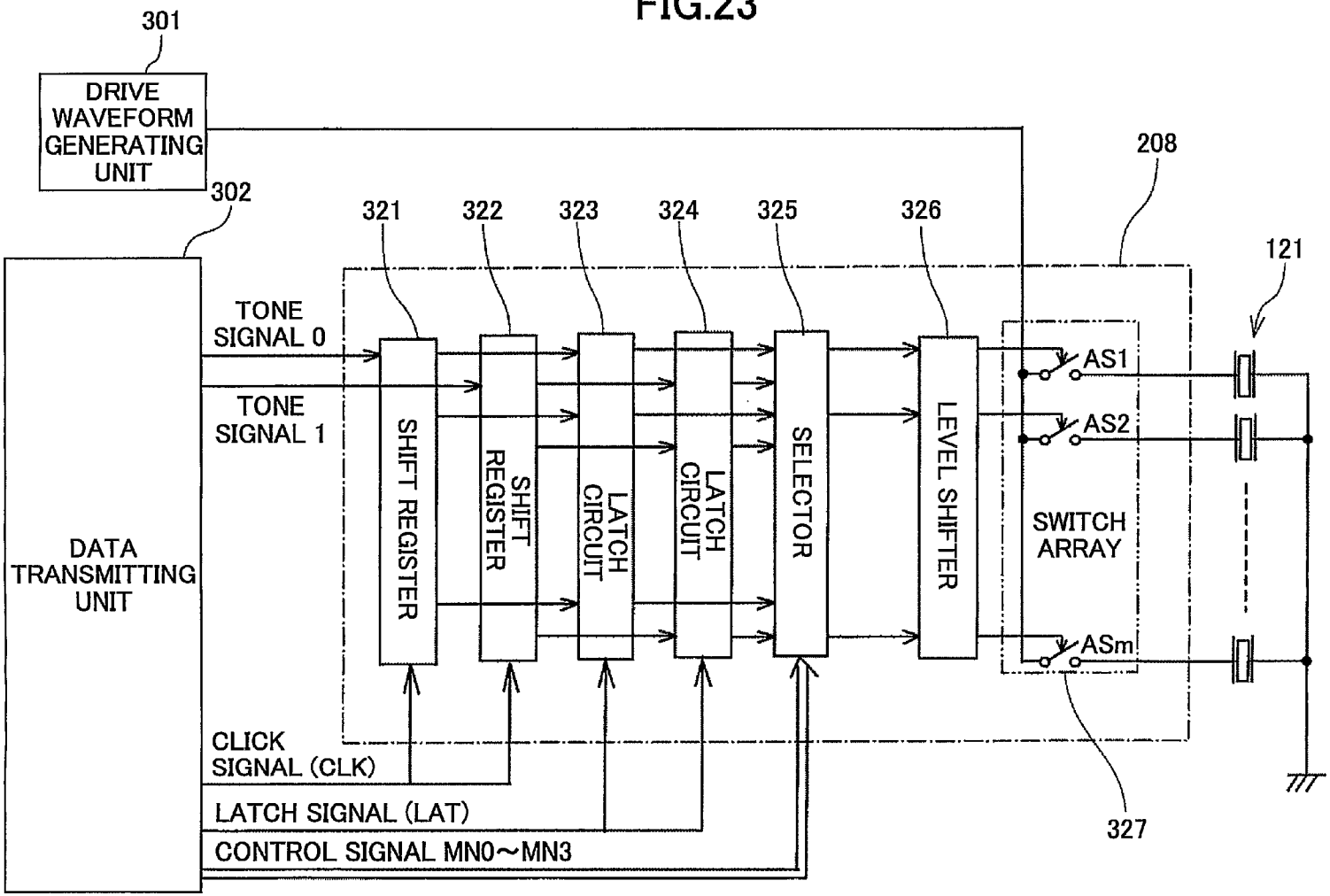
FIG. 23 is a block diagram illustrating exemplary configurations of the head drive control unit and the head driver of the control part of FIG. 14 according to another example.

FIG. 23 is a block diagram showing exemplary configurations of the head drive control unit 207 and the head driver 208 of the control part 200 according to another embodiment of the present invention. It is noted that in this drawing, components that are identical to those shown in FIG. 15 are given the same reference numerals.

According to the present embodiment, the head drive control unit 207 includes a drive waveform generating unit 301 that is configured to generate and output a drive waveform (common drive waveform) including plural drive pulses (drive signals) within one printing period, and a data transmitting unit 302 that is configured to output two bit image data (tone signal 0, 1) according to a print image, a clock signal, a latch signal (LAT), and control signals M0-M3.

The control signals correspond to two bit signals for designating the on/off state of an analog switch array 327 of the head driver 208 (described in detail below) for each droplet to be discharged. The on/off state of the control signals is switched according to whether a drive pulse within a printing period of the common drive waveform is to be selected. Specifically, the control signals may be set to high level H (on) to select a corresponding drive pulse, and set to low level L (off) when a corresponding drive pulse is not selected. It is noted that the control signals include a signal for selecting a large droplet (1, 1), a signal for selecting a medium droplet (1, 0), a signal for selecting a small droplet (0, 1), and a signal for selecting non-discharge (0, 0).

The head driver 208 includes a shift register 321 for inputting a tone signal 0 that is serially transmitted by a transmission clock (shift clock) from the data transmitting unit 302 and a clock signal CLK, a shift register 322 for inputting a tone signal 1 from the data transmitting unit 302 and the clock signal CLK, a latch circuit 323 for latching the registered value of the shift register 321 by a latch signal LAT from the data transmitting unit 302, a latch circuit 324 for latching the registered value of the shift register 322 by the latch signal LAT from the data transmitting unit 302, a selector 325*a* level converting circuit (level shifter) 326 for selecting one of the control signals M0-M3 supplied from the data transmitting unit 302 and outputting the selected control signal to a level converting circuit (level shifter) 326, the level shifter 326 for converting a logic level voltage signal of the selector 325 to a level operable for the analog switch array 327, and the analog switch array 327 including analog switches AS1-Asn (non-discriminately referred to as 'analog switch AS') that are switched on/off by the output of the selector 325 supplied via the level shifter 326.

It is noted that each of the analog switches AS1-ASn of the analog switch array 327 is connected to the selection electrode (individual electrode) 154 of each piezoelectric element 121, and is configured to input the common drive voltage supplied from the drive waveform generating unit 301. Accordingly, when the analog switch AS is switched on according to the control signal selected based on the serially transmitted image data (tone data 0, 1), the corresponding drive signal (drive pulse) of the common drive waveform is passed (selected) to thereby be applied to the piezoelectric element 121.

In the following, a drive waveform and a data transmitting method used in a third embodiment of the present invention are described with reference to FIGS. 24 and 25.

Figure 24:
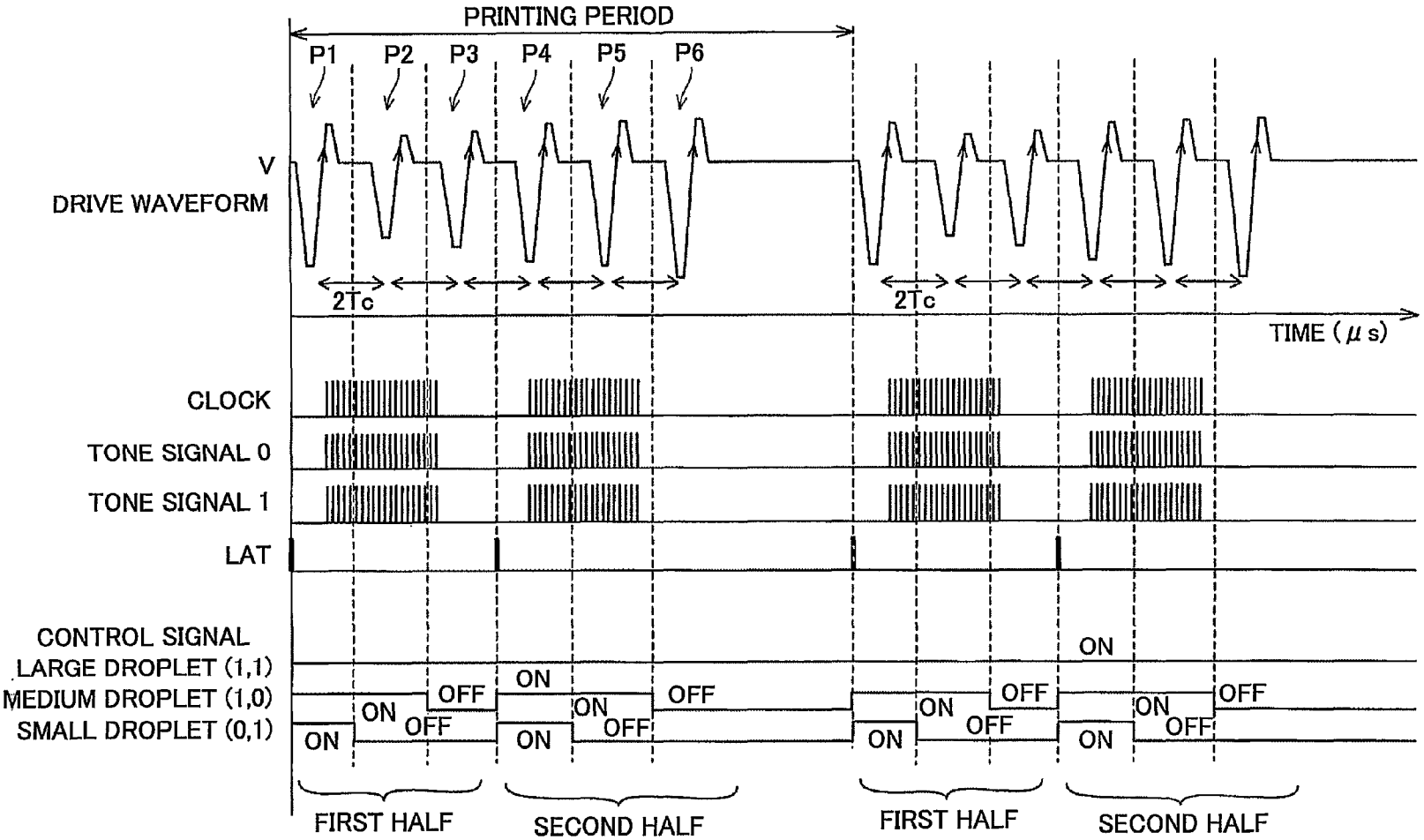
FIG. 24 is a diagram illustrating a drive waveform and a data transmitting method used in a third embodiment of the present invention.

According to the present embodiment, the drive waveform generating unit 301 is configured to generate and output a drive waveform as is shown in FIG. 24 that includes six drive pulses (i.e., first pulse P1 through sixth pulse P6) within one printing period. The first pulse P1 through sixth pulse P6 are respectively arranged within time intervals of 2Tc corresponding to a time period twice the characteristic vibration period Tc of the liquid chamber 106. In this way, pressure resonance may be effectively used, discharge characteristics may be improved, and the drive voltage may be decreased one the whole. It is noted that in the present embodiment, the respective voltages of the drive pulses P1-P6 are conditioned and controlled so that the pressure resonance does not exceed its limit and cause instability in discharging operations.

Also, it is noted that each of the pulses P1-P6 has a waveform that falls from a reference potential V to be held at a predetermined level, then rises to a potential above the reference potential V to be held once more at a predetermined level, and then falls to the reference potential V. It is noted that the pulses P1-P6 are arranged to have difference fall potentials in the present embodiment.

Also, according to the present embodiment, the data transmitting unit 302 is configured to transmit the tone signal 0 and the tone signal 1 two times within one printing period using the transmission clock (CLK) as is shown in FIG. 24. In this case, the timing of the latch signal (LAT) that regulates data rewriting is arranged to correspond to periods during which the drive waveform is flat as is shown in FIG. 24. It is noted that during the time data are rewritten, the on/off state of the analog switch AS of the head driver (driver IC) 208 may be unstable. Accordingly, the latch timing is preferably set to a suitable timing according to the time required for data transmission and the drive waveform.

In the following descriptions, upon referring to the two data transmissions of tone data (tone signals 0, 1) performed within one printing period, the first data transmission is referred to as 'first half' and the second data transmission is referred to as 'second half'. In the present embodiment, tone data transmitted in the first half are latched to be used for selection of the drive pulses P4-P6 of the drive waveform of the second half. The tone data used during the first half corresponds to tone data transmitted in the second half of a previous printing period.

FIG. 25 is a table illustrating selection of the drive waveform (i.e., selection of the drive pulse to be used) according to the present embodiment. Specifically, the table of FIG. 25 indicates whether droplets are discharged by the respective drive pulses P1-P6 depending on the control signal.

It is noted that in the present embodiment, the number of droplets that are discharged is arranged to be incremented one droplet at a time in response to incrementing the number of drive pulses selected by the control signals.

Specifically, no droplet is discharged when non-discharge is designated in the first half; one droplet is discharged by the first pulse P1 when a small droplet is designated in the first half; two droplets are discharged by the first and second pulses P1 and P2 when a medium droplet is designated in the first half; three droplets are discharged by the first, second, and third pulses P1-P3 when a large droplet is designated in the first half; one droplet is discharged by the fourth pulse P4 in addition to the three droplets discharged by the first through third pulses P1-P3 in the first half to thereby discharge four droplets when a small droplet is designated in the second half; similarly, two droplets are additionally discharged by the fourth and fifth pulses P4 and P5 to thereby discharge five droplets when a medium droplet is designated in the second half; and three droplets are additionally discharged by the fourth through sixth pulses P4-P6 to thereby discharge six droplets when a large droplet is designated in the second half.

According to the present embodiment, seven tone levels (i.e., droplets in six different sizes and non-discharge) may be realized.

Specifically, in the present embodiment, tone data are arranged to be transmitted from the data transmitting unit 302 twice within one printing period to realize the seven tone levels. In this case, changes do not have to be implemented on the data driver IC (head driver) 208 side, and the number of bits of the tone data does not have to be increased. In this way, the number of different tone levels that can be represented by the tone data may be increased without increasing the drive frequency. In other words, the drive waveform of the present example is configured to handle a set of six drive pulses as opposed to handling a set of three drive pulses using a drive frequency that is two times higher than the present drive frequency, and in this way, a large droplet may be stably discharged.

It is noted that the drive waveform of the present embodiment that realizes an increase in the number of tone levels is illustrated as including six drive pulses. However, the present embodiment is not limited to this illustrative example, and in the case where two bit tone data are used, advantageous effects may be realized with respect to tone level representation when at least four drive pulses are included in the drive waveform (i.e., when a maximum number of at least four droplets may be discharged within one printing period).

Specifically, in the case of using two bit data as tone data, in theory, only four tone levels can be represented by the tone data. That is, in addition to non-discharge, droplets in three different sizes may be represented by two bit tone data. In this case, droplet amounts (sizes) can be increased one droplet at a time only when the number of drive pulses included in the drive waveform is arranged to be no more than three pulses; that is, when four or more drive pulses are included, at least one droplet size to a next droplet size is increased by two or more droplets. However, according to the present embodiment, by transmitting tone data plural times within one printing period, droplet sizes may be increased one droplet (one pulse) at a time even when more than three drive pulses are included in the drive waveform of one printing period.

As can be appreciated from the above descriptions, by transmitting tone data of plural bits per channel to the head driver 208 plural times within one printing period, even when the time interval of the plural drive pulses included in the drive waveform is shortened, the drive signals may be individually selected; and by transmitting the tone data plural times, the substantial number of tone levels may be increased. In this way, high quality imaging and high speed printing may be realized at the same time.

It is noted that in the above illustrated embodiment, a control signal is used to select the respective drive pulses of the drive waveform; however, the present invention is not limited to such an example, and a decoder may be used to achieve similar effects as well.

Also, it is noted that in the illustrated embodiment, a serial imaging apparatus is used; however, the present invention is not limited to such an example, and the present embodiment may be applied to an imaging apparatus using a full-line recording head in another example. Specifically, in an imaging apparatus including a full-line recording head, the number of tone levels that can be represented by tone data may be increased by transmitting tone data plural times within one printing period based on the relationship between the bit number of the tone data to be transmitted and the number of pulses that are used to discharge droplets.

It is noted that in a full-line imaging apparatus according to a preferred embodiment, the plural droplets discharged for forming a large droplet are arranged to be merged before landing on recording paper (i.e., the discharged droplets are merged in midair) to facilitate solid image formation in the nozzle array direction, and in this way, a relatively small droplet and a relatively large droplet may be realized at the same time (i.e., the range of droplet sizes may be widened).

As can be appreciated from the above descriptions, according to the present embodiment, by transmitting tone data plural times within one printing period, the number of tone levels may be increased to realize a continuous tone image, and in the case of realizing a tone level that requires the discharge of plural droplets (i.e., large droplet), by arranging plural discharged droplets to merge before landing on recording paper, ink may be arranged to adequately spread in the sub scanning direction after the droplet lands on the recording paper so that imaging may be realized with a suitable amount of ink and penetration of ink to the other side may be prevented, for example.

Also, in the present embodiment, the number of droplets that may be discharged within one printing period; namely, the number of drive signals within one printing period, exceeds the number of tone levels that can be represented by tone data (e.g., four tone levels in the case of two-bit tone data), and thereby, a wider range of droplet amounts (droplet sizes) may be realized without raising the circuit cost and the substantial number of tone levels may be increased.

Specifically, by arranging the number of droplets that may be discharged within one printing period to be greater than four droplets in the case of using two bit tone data, the substantial number of tone levels may be increased without raising the circuit cost, for example.

In the following, a drive waveform and a data transmitting method used in a fourth embodiment of the present invention are described with reference to FIGS. 26 and 27.

Figure 26:
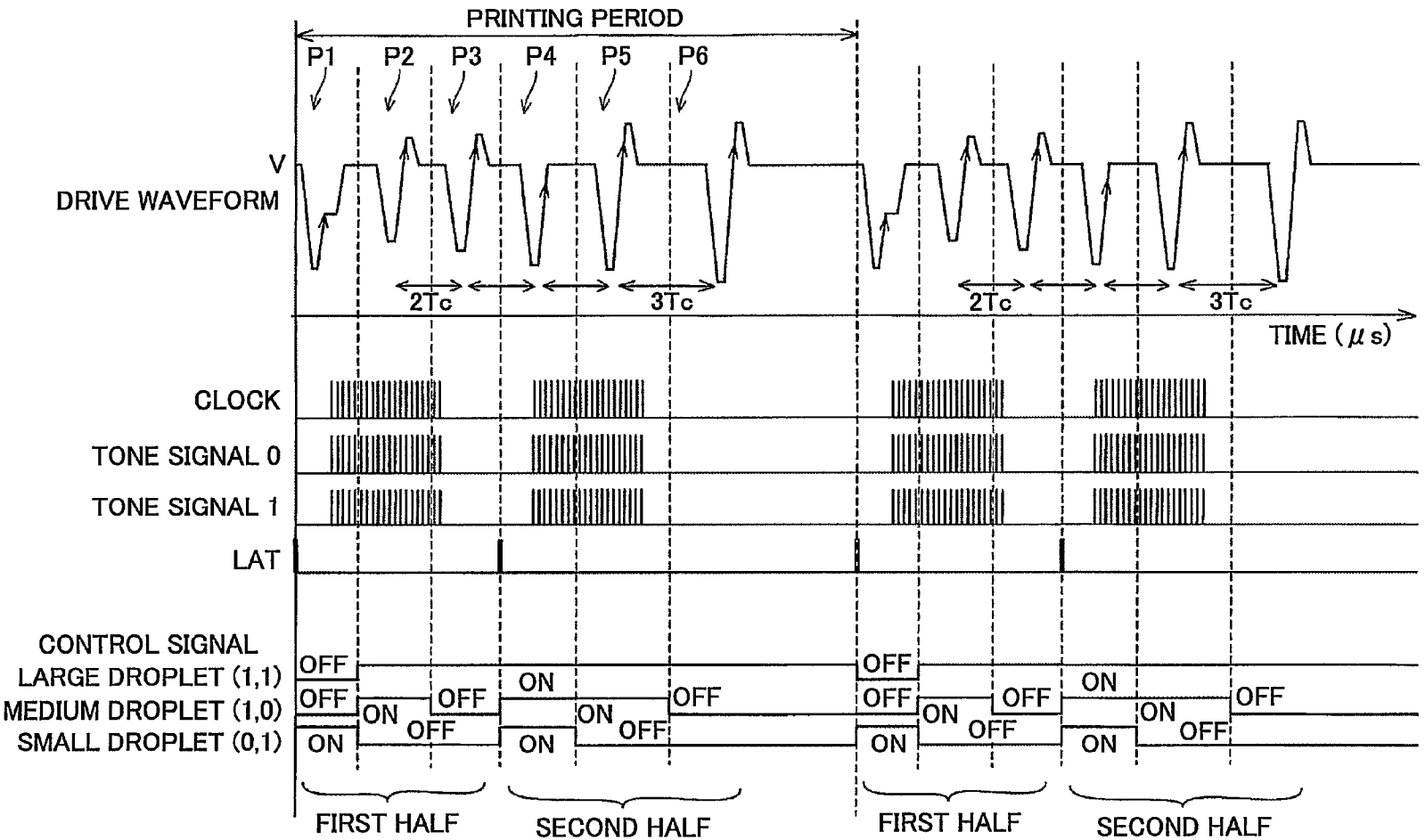
FIG. 26 is a diagram illustrating a drive waveform and a data transmitting method used in a fourth embodiment of the present invention.

As is illustrated in FIG. 26, the waveform used in the present embodiment includes six drive pulses as with the drive waveform used in the third embodiment as is illustrated in FIG. 24; however, drive pulses with differing shapes make up the drive waveform of the present embodiment.

Specifically, the first pulse P1 of the present drive waveform is dedicated for discharging a very small droplet. The waveform of the first pulse P1 is arranged to fall from a reference potential V to be held at a predetermined level, and then rise back to the reference potential in two stages. In the first rise stage, droplet discharge is realized to form a very small droplet, and in the second rise stage, no droplets are discharged.

Also, the waveform of the fourth pulse P4 is arranged to be different from the second, third, fifth, and sixth pulses P2, P3, P5, and P6. Specifically, the fourth pulse P4 is arranged to rise only up to the reference potential V. The interval between the fifth pulse P5 and the sixth pulse P6; namely, the discharge interval between the fifth droplet and the sixth droplet, is arranged to be longer than the discharge intervals between other droplets at three times the liquid chamber characteristic vibration period Tc (i.e., 3Tc). Also, it is noted that in the present embodiment, tone data are transmitted plural times (e.g., two times) within one printing period as in the third embodiment.

FIG. 27 is a table indicating whether droplets are discharged by the pulses P1-P6 according to the selection of the pulses P1-P6 by the control signals shown in FIG. 26. In the present embodiment, the first pulse P1 is provided solely for forming a small droplet (0, 1) in the first half.

As can be appreciated from the above descriptions, the manner of selecting the respective drive pulses of the drive waveform is not limited to a particular scheme in the present invention. Also, the shapes of the drive pulses making up the drive waveform and the discharge interval (pulse interval) of the drive waveform are not limited to a particular arrangement. According to embodiments of the present invention, drive pulses with differing shapes may be arranged at differing intervals within a waveform.

In the following, a drive waveform and a data transmitting method used in a fifth embodiment of the present invention are described with reference to FIGS. 28 and 29.

Figure 28:
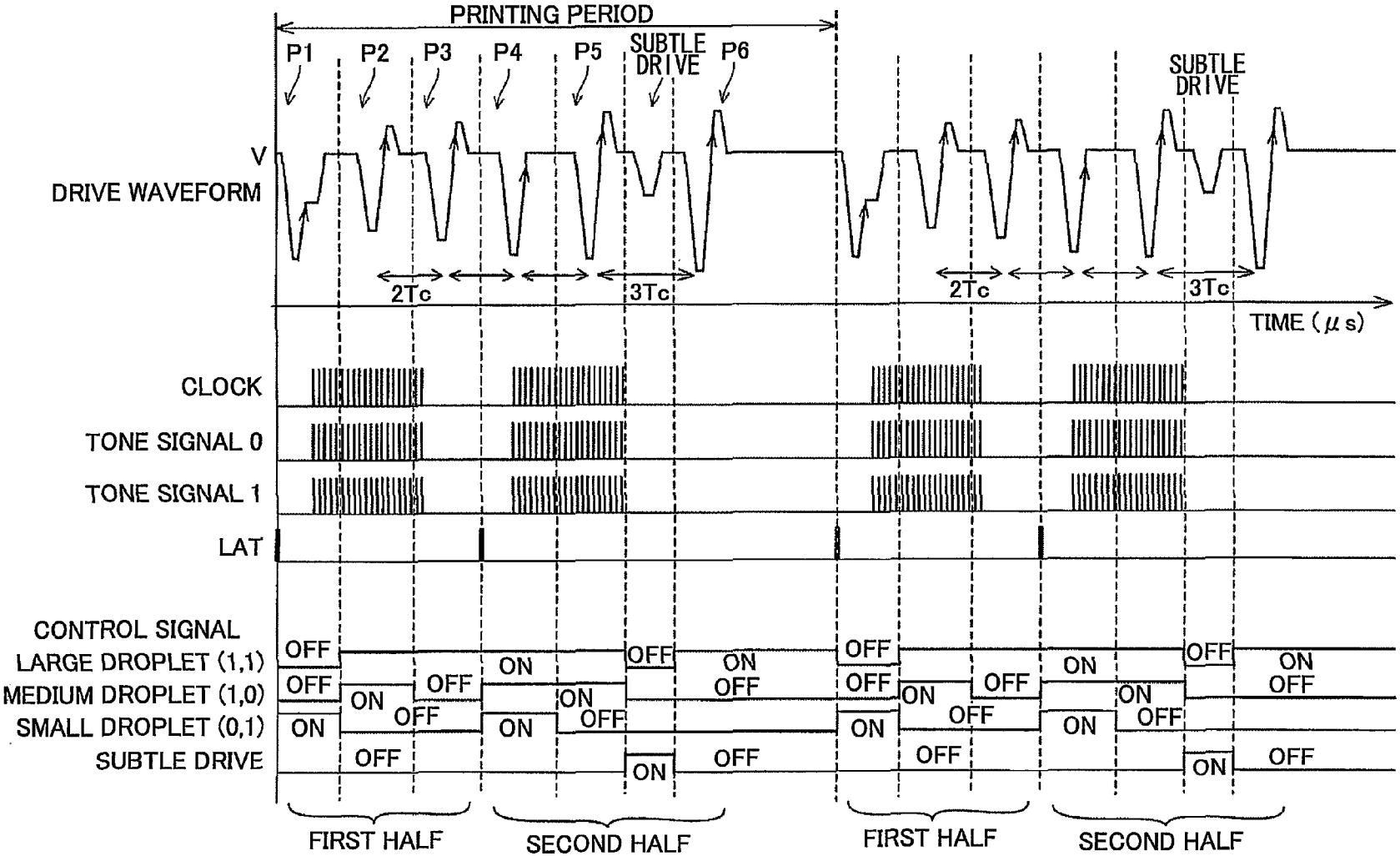
FIG. 28 is a diagram illustrating a drive waveform and a data transmitting method used in a fifth embodiment of the present invention.

As is shown in FIG. 28, the drive waveform used in the present embodiment includes a subtle pulse for vibrating the meniscus inserted between the fifth pulse P5 and the sixth pulse P6 of the drive waveform according to the fourth embodiment shown in FIG. 26. The subtle pulse is configured to vibrate the nozzle meniscus by applying pressure that is adequately low to avoid ink droplets from being discharged in order to prevent discharge defects caused by the drying of ink at the nozzle during printing. Also, it is noted that in the present embodiment, tone data (tone signals 0 and 1) are transmitted plural times (e.g., two times) within one printing period as in the third and fourth embodiments described above.

FIG. 29 is a table indicating whether droplets are discharged by the first through sixth drive pulses P1-P6 and a subtle drive by the subtle pulse is initiated according to the selection of the first through sixth drive pulses P1-P6 and the subtle pulse by the control signals shown in FIG. 28.

In the present embodiment, the tone level designating non-discharge may be assigned to realize the subtle drive. It is noted that in the present embodiment, the drive pulses do not necessarily have to be selected over a continuous range. For example, the analog switch AS may be set off during the interval of the subtle drive pulse for a channel that is set to another tone level.

In the following, a drive waveform and a data transmitting method used in a sixth embodiment of the present invention are described with reference to FIGS. 30 and 31.

Figure 30:
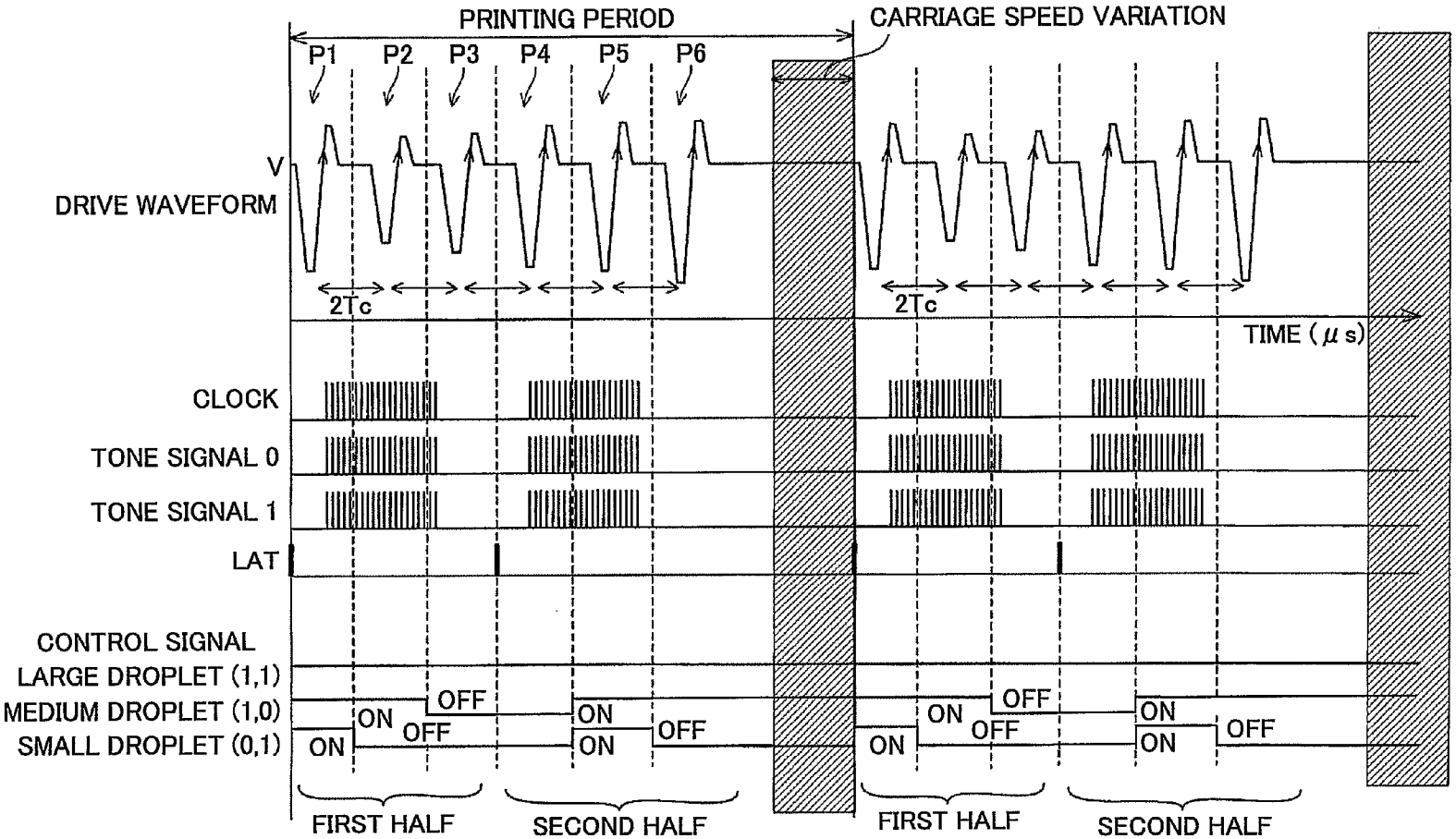
FIG. 30 is a diagram illustrating a drive waveform and a data transmitting method used in a sixth embodiment of the present invention.

As is shown in FIG. 30 the waveform used in the present embodiment is substantially identical to the waveform used in the third embodiment as is shown in FIG. 24. Also, in the present embodiment, tone data are transmitted plural times (e.g., twice) within one printing period as in the third through fifth embodiments.

FIG. 31 is a table indicating whether droplets are discharged by the drive pulses P1-P6 according to the selection of the drive pulses P1-P6 by the control signals shown in FIG. 30.

According to the present embodiment, when the small droplet (0, 1) is designated in the first half, the first pulse P1 is selected to thereby discharge one droplet; when the medium droplet (1, 0) is designated in the first half, the first and second pulses P1 and P2 are selected to thereby discharge two droplets; when the small droplet (0, 1) is designated in the second half, the fifth pulse P5 is selected to thereby discharge one droplet; when the medium droplet is designated in the second half, the fifth and sixth pulses P5 and P6 are selected to thereby discharge two droplets; and when the large droplet (1, 1) is designated, all the pulses P1-P6 are selected to thereby discharge six droplets.

According to the present embodiment, tone data (tone signals 0 and 1) are transmitted twice within one printing period, and with respect to the small and medium droplets, droplet discharge is performed independently in the first half and the second half using independent drive pulses for the first half and the second half, respectively, to realize dot formation. The present embodiment is adapted for a case in which the main scanning resolution and the sub scanning resolution are arranged to differ.

In this case, at least one drive signal of the plural drive signals included in the drive waveform used for forming the large droplet is configured to be used for forming a droplet other than the large droplet (e.g., medium droplet) based on tone data transmitted in a later data transmission of the plural data transmissions. In this way, the time of the overall drive waveform may be reduced and the printing period may be reduced so that the printing speed may be increased.

Figure 32A:
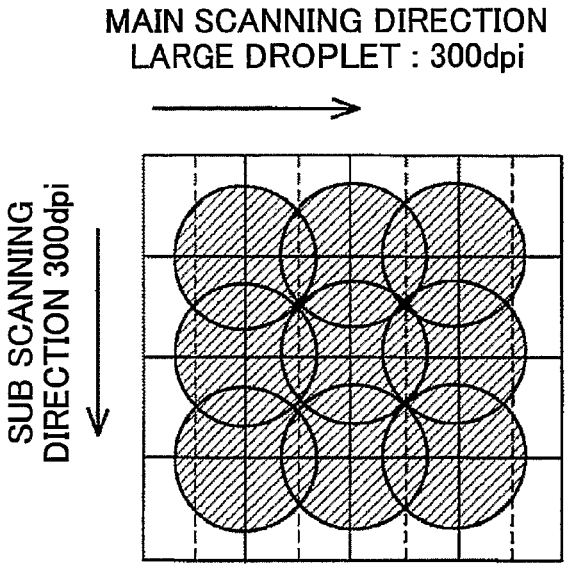
FIGS. 32A and 32B are diagrams respectively illustrating printing using a large droplet and printing using a medium/small droplet in the sixth embodiment.
Figure 32B:
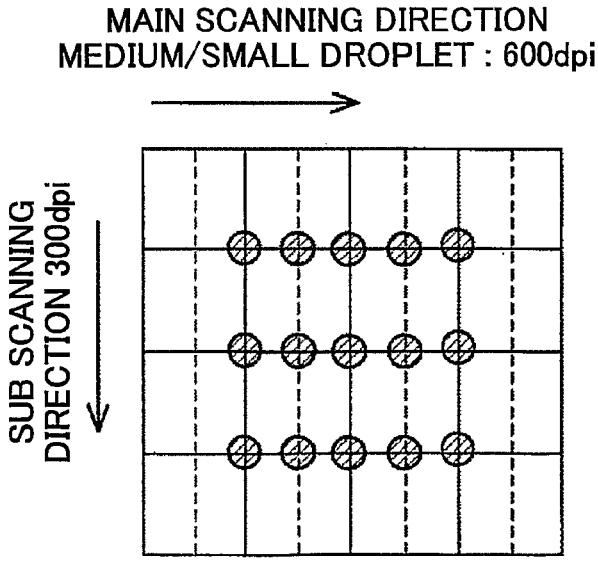

FIGS. 32A and 32B are diagrams illustrating dot formation according to the present embodiment.

It is noted that the basic resolution for dot formation in the present example is 300 dpi. Specifically, two rows of nozzle arrays having a nozzle pitch of 1500 dpi are used to perform non-interlaced imaging to thereby realize a resolution of 300 dpi in the sub scanning direction.

With respect to the main scanning direction, one printing period is arranged to correspond to the period in which droplets at 300 dpi may be discharged in accordance with the resolution in the sub scanning direction. In this case, the large droplet may be arranged into a droplet amount adequate for forming a solid image through forming dots at 300 dpi×300 dpi as is shown in FIG. 32A. In the example illustrated in FIG. 30, six droplets are discharged within one printing period, and the discharged droplets are merged before adhering to recording paper to form one large droplet.

On the other hand, referring to FIG. 31, a small droplet is formed in the first half using the first pulse P1 and is formed in the second half using the fifth pulse P5. A medium droplet is formed in the first half using the first and second pulses P1 and P2, and is formed in the second half using the fifth and sixth pulses P5 and P6.

It is noted that in the third through fifth embodiments described above, tone data are transmitted twice within one printing period, and the tone level are determined based on the combination of the tone data transmitted in the first half and the second half. However, in the present embodiment, imaging is independently performed in the first half and the second half in the case of forming small or medium droplets.

In other words, small and medium droplets may be discharged twice over one printing period in the present embodiment, and accordingly, as is shown in FIG. 32B, a main scanning direction resolution of 600 dpi which is two times the basic resolution of 300 dpi of the present example may be realized in the case of forming small and medium droplets.

In this way, the density range that may be represented by the small and medium droplets may be increased, and advantageous effects may be obtained particularly with respect to density continuity of a highlighted image. Also, the density range that may be represented without including the large droplet may be increased so that graininess of an image may be reduced.

According to the present embodiment, a printing mode is realized in which only the resolution in the main scanning direction for forming a solid image (i.e., discharging large droplets) is arranged to correspond to the sub scanning direction resolution so that the droplets may be arranged to adequately cover a solid image region with respect to the sub scanning direction. Also, according to the present embodiment, the resolution in the main scanning direction for discharging small droplets (small/medium droplets in the case of four tone levels) may be increased so that tone jump may be prevented from occurring in a highlighted image. In the present embodiment, the droplets for forming a solid image may be shifted to a high density tone level so that graininess of the solid image may be reduced and image quality may be improved.

Figure 33A:
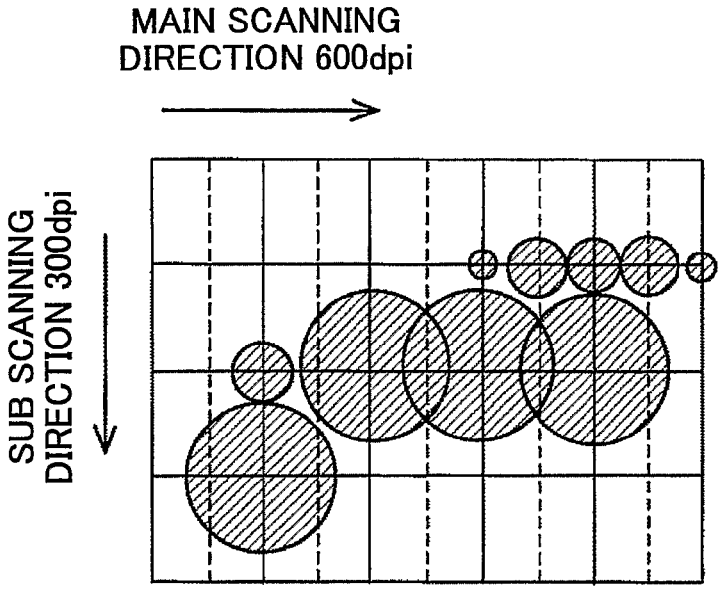
FIGS. 33A and 33B are diagrams illustrating an advantageous effect realized in the sixth embodiment.
Figure 33B:
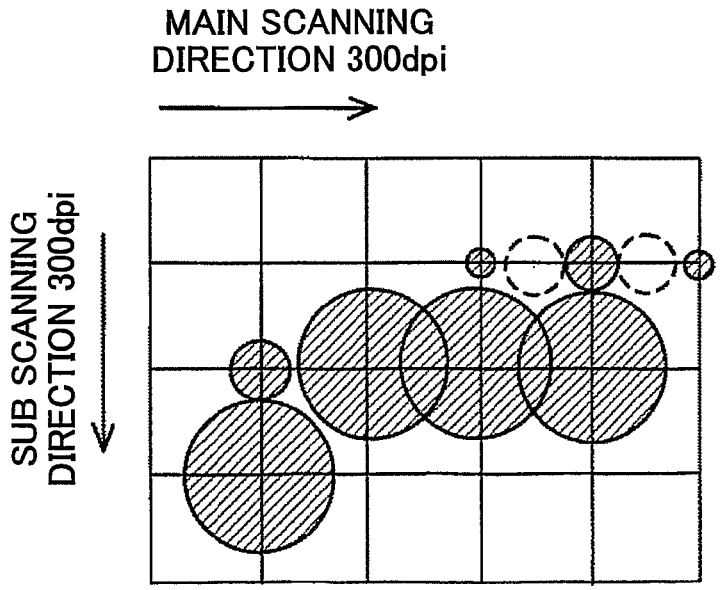

In the present embodiment, shagginess correction may be realized by smoothing rough edges of characters using the medium and small droplets as is illustrated in FIG. 33A, for example. It is noted that FIG. 33B is a diagram illustrating a comparison example in which the medium and small droplets are discharged at 300 dpi×300 dpi. As can be appreciated from these drawings, a smoother edge may be realized by discharging small/medium droplets at 600 dpi×300 dpi as in the present embodiment.

Figure 6A:
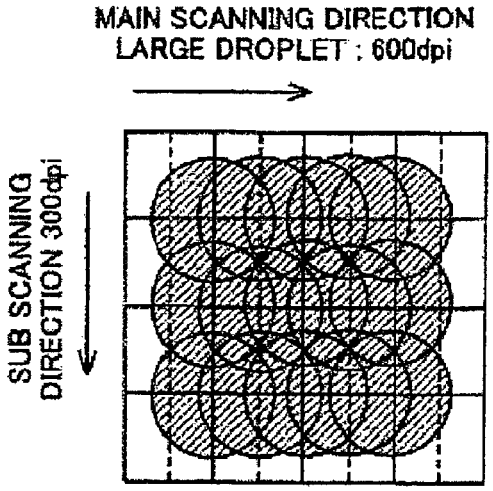
FIG.6A Prior Art
FIGS. 6A and 6B are diagrams illustrating different dot sizes and respective arrangements thereof in a case where the printing resolution in the main scanning direction is double with respect to the example of FIGS. 5A and 5B.
Figure 6B:
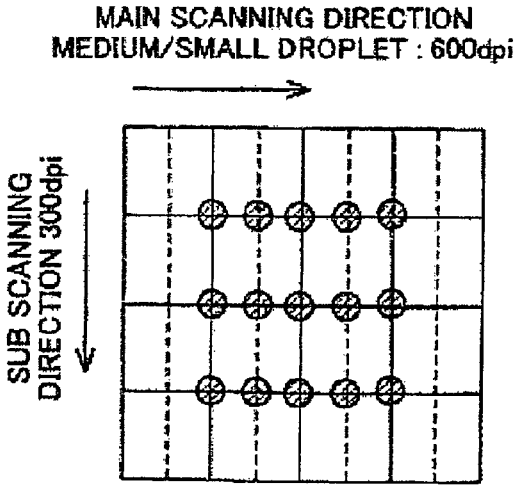
FIG.6B Prior Art
Figure 7:
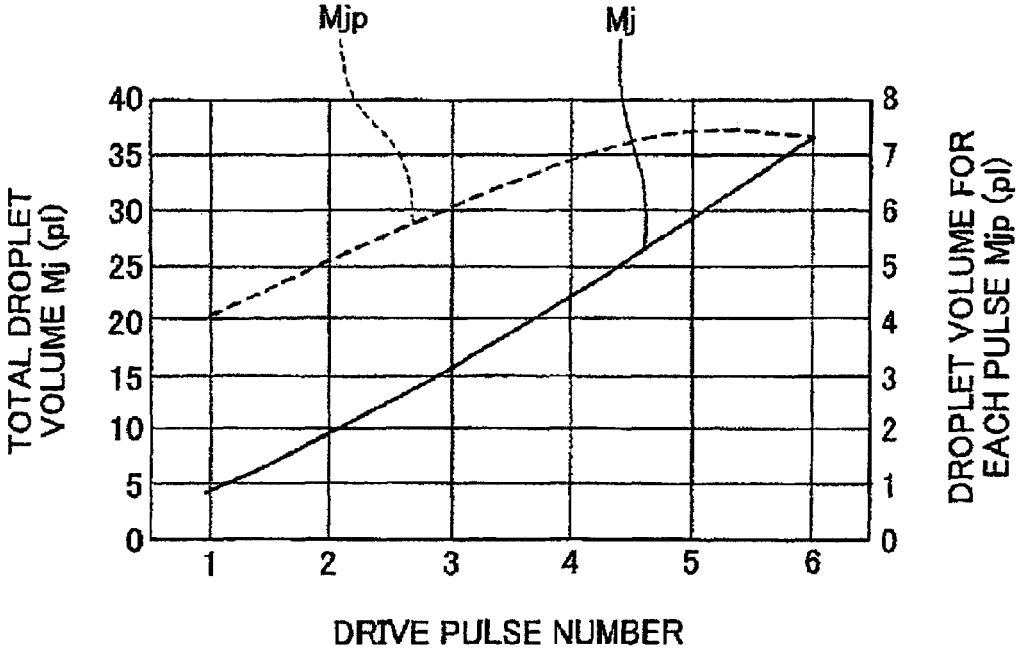
FIG.7 Prior Art
FIG. 7 is a graph illustrating a relationship between the total droplet volume and the individual droplet volume discharged by each drive pulse.

On the other hand, the resolution in the main scanning direction for discharging the large droplets is arranged to correspond to the resolution in the sub scanning direction (i.e., 300 dpi) in the present embodiment so that a solid image may be formed using a smaller amount of recording liquid. Specifically, as is described above with reference to FIGS. 6A and 6B, even when the resolution in the main scanning direction for discharging large droplets is increased to 600 dpi as with the resolution for discharging the small/medium droplets, a droplet amount reduced to half the current large droplet amount, for example, may not be sufficient for accurately forming a solid image in the sub scanning direction; that is, a larger droplet amount is needed to cover a solid image region in the sub scanning direction.

Also, in the present embodiment, plural droplets are successively discharged to form one large droplet. In such a case, the voltages and time intervals of the overall waveform may have to be strictly conditioned and controlled in order to realize stable discharge. Accordingly, in the present embodiment, one printing period is based on the formation of the large droplet so that stable droplet discharge may be realized. Further, the discharged droplet amount may be increased by adding droplets corresponding to a subsequent transmission (e.g., the fourth through sixth droplets in the illustrated embodiment) so that a large droplet may be efficiently formed.

It is noted that in the above illustrated embodiment, plural droplets are merged before adhering to paper to form the large droplet so that the large droplet may effectively cover the solid image region in the sub scanning direction; however, it is noted that the droplets do not necessarily have to be merged in the present embodiment.

Also, it is noted that in the example illustrated in FIG. 30, latching (tone data rewriting) is realized at the time point between the third pulse P3 and the fourth pulse P4; however, since the fifth pulse P5 is used in the present example to form a small droplet in the second half, the latching (tone data rewriting) may alternatively be performed at the time point between the fourth pulse P4 and the fifth pulse P5. In other words, the latching timing may be set so that transmission of tone data of the first half and the second half may be realized on time.

Also, according to a preferred embodiment, in a case where a serial imaging apparatus is used, a position reference such a linear encoder may be arranged with respect to the main scanning direction (see linear encoder 74 of FIGS. 8 and 14) to correct speed variations of the carriage that includes the recording head.

In this case, the drive waveform is generated in response to a signal (position reference signal) from the linear encoder 74 as a trigger signal to discharge liquid droplets, and thereby, the drive waveform may be arranged to be in sync with the position reference signal, but the printing period may not be constant since the printing period is adjusted according to the carriage speed variation. Accordingly, the time of the drive waveform and the data transmission for transmitting the tone data have to be adapted for the fastest carriage speed of the carriage speed variation range (although such time may vary depending on the specifications of the carriage speed variation).

It is noted that the hatched areas in FIG. 30 represent the time range provided with respect to the carriage speed variation. In the present embodiment, the drive pulses for forming a large droplet are controlled as one set so that extra time (idle time) generated according to the carriage speed variation may be reduced on the whole.

For example, in the case of printing at a resolution of 600×300 dpi under normal conditions; that is, even for discharging a large droplet, the position reference signal generated from the linear encoder 74 is arranged to correspond to the time interval for discharging a droplet at 600 dpi. Specifically, in this case, three pulses transmitted in the first half and the second half are respectively handled as individual sets, and a time range for allowing carriage speed variation has to be arranged between the first half and the second half. In this case, since an adequate amount of time has to be secured between drive waveforms to realize stable discharge, time for allowing two carriage variations has to be secured for the two sets of pulses. However, in the present embodiment, since a large droplet is formed using a set of drive pulses included within a time interval for discharging a droplet at 300 dpi as opposed to 600 dpi, the printing period may be adequately controlled by securing time for one carriage variation between sets of drive pulses for forming one large droplet.

As can be appreciated from the above descriptions, forming a large droplet using six pulses according to the present embodiment is different from forming two droplets at 600 dpi×300 dpi. Specifically, in the case of sequentially discharging plural droplets over the first half and the second half as in the present embodiment, the sequencing timing of the pulses has to be fixed in order to control the remaining pressure within the pressurizing liquid chamber to realize stable discharge and the desired droplet amount.

It is noted that since the visibility of the dots formed by the small/medium droplets is not very high, slight deviations in the landing positions of the small/medium droplets may not cause significant image degradation (although position deviations and differences in droplet amounts may occur since the drive waveform prioritizes the large droplet formation). In fact, since the discharging resolution of the small/medium droplet in the main scanning direction may be superficially increased as is described above, the image quality may be improved from this aspect.

In the present embodiment, a large droplet that is formed by plural droplets is arranged to be discharged based on a reference signal obtained from a carriage position signal (linear encoder), and tone data are latched from the reference signal at appropriate timings (to perform a subsequent data transmission of plural data transmissions) so that position deviation of the large droplet may be prevented and high quality imaging may be realized.

In the following, a drive waveform and a data transmitting method used in a seventh embodiment of the present invention are described with reference to FIGS. 34 and 35.

The waveform used in the present embodiment includes first through eighth pulses P1-P8. The second pulse P2 and the sixth pulse P6 of the present waveform that are identical in shape are used solely for forming a small droplet; and the first pulse P1 and the fifth pulse P5 of the present waveform that are identical in shape are used for forming a medium droplet or a large droplet. Also, tone data (tone signals 0 and 1) are transmitted twice within one printing period as in the third through sixth embodiments described above.

Figure 34:
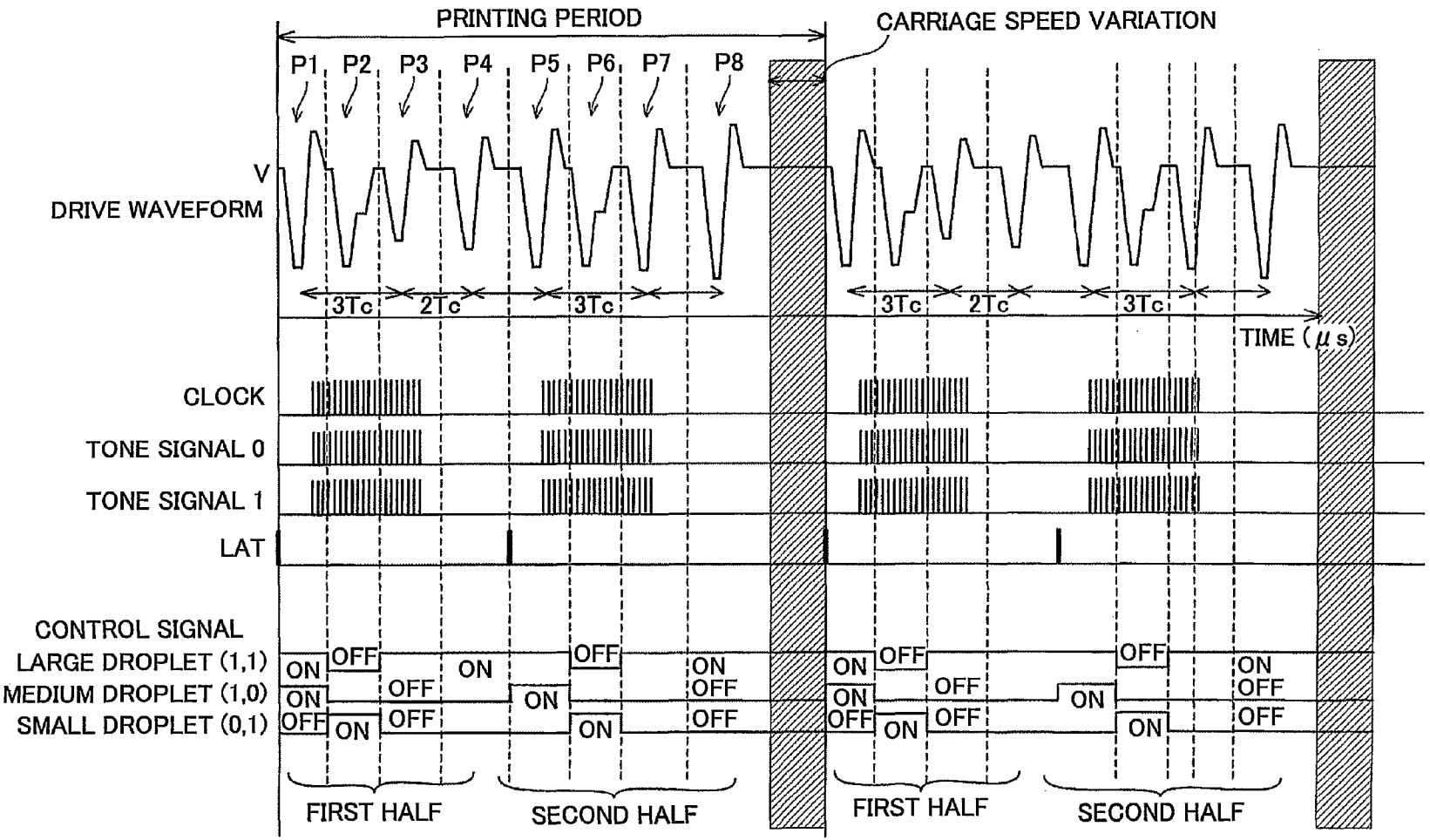
FIG. 34 is a diagram illustrating a drive waveform and a data transmitting method used in a seventh embodiment of the present invention.

FIG. 35 is a table indicating whether droplets are discharged by the pulses P1-P8 according to the selection of the pulses P1-P8 by the control signals shown in FIG. 34. As is shown in this drawing, a small droplet (discharged by pulses P2 and P6) and a medium droplet (discharged by pulses P1 and P5) are arranged to realize dot formation independently in the first half and the second half as in the sixth embodiment described above. That is, the large droplet is configured to realize imaging at 300×300 dpi, and the medium/small droplet is configured to realize imaging at 600×300 dpi.

In the present embodiment, the pulse waveforms used for forming the small droplet in the first half and the second half are not included in the pulse waveform for forming the large droplet, and are arranged to have identical shapes. The pulse waveforms used for forming the medium droplet in the first half and the second half are included in the pulse waveform for forming the large droplet, and are arranged to be identical in shape. In this way, the droplet amounts of the small/medium droplet may be arranged to be identical in the first half and the second half so that image formation may be facilitated, and image quality may be improved.

It is noted that with regard to image quality, identical pulses are preferably used for forming small/medium droplets in the first half and the second half so that the droplet amounts of the small/medium droplets formed in the first half and the second half may be the same. It is noted that in another embodiment, independent pulses for forming the medium droplet may also be included in the drive waveform provided that the pulses may be accommodated within the appropriate printing period.

In the case where drive pulses for forming the medium droplet in the first half and the second half are included in the drive pulse for forming the large droplet and are arranged to have identical shapes as in the present embodiment, waveform constraints are additionally imposed on the drive pulse waveform for forming the large droplet, and thereby, the pulse for forming the medium droplet is preferably arranged at an intermediate point so that adjustments may be made by subsequent pulse waveforms (droplets).

In the illustrated embodiment, the fifth pulse P5 is arranged to have the same shape as the first pulse P1 and is used to form the medium droplet. Thus, in the case of forming the large droplet, the discharge speed of the droplet discharged by the fifth pulse may be slightly slower than that of the other pulses. Accordingly, this may be compensated by adjusting the waveforms of the subsequent seventh and eighth pulses P7 and P8 (i.e., fifth and sixth droplets discharged for forming a large droplet) to enable droplet discharge at a slightly faster droplet discharge speed.

It is noted that the droplet discharge speed of the droplet discharged by the fifth pulse P5 is decreased in the case of forming a large droplet owing to the fact that droplets are successively discharged by the previous pulses to cause a rise in the meniscus. Although such a rise in the meniscus can realize an increase in the droplet amount, under normal conditions, the applied voltage has to be raised in accordance with an increase in the droplet amount to supply the corresponding discharge energy. When the same voltage as that applied for discharging the first droplet (in which no rise in the meniscus occurs) is used for a droplet by the fifth pulse P5, the discharge speed may be slightly slower. Accordingly, by arranging the pulse for forming the medium droplet in between plural pulses for forming the large droplet, correction may be performed by the subsequent droplets.

It is noted that in the present embodiment, the droplet discharge timing is set to a timing that enables stable successive discharge of large droplets.

As can be appreciated from the above descriptions, the drive pulse used in the present embodiment includes at least two drive signals for discharging droplets of substantially the same size at least twice based on tone data transmitted plural times within one printing period to thereby improve image quality. The drive signals for discharging droplets of substantially the same size at least twice may not be configured to be used for discharging droplets of other sizes so that accuracy in the droplet sizes may be realized. Also, the drive signals for discharging droplets of substantially the same size at least twice may be configured to be used for discharging droplets of one or more other sizes so that the overall time of the drive waveform (printing period) may be reduced.

In the following, an eighth embodiment of the present invention is described.

In the present embodiment, the printing mode may be switched between a mode using the waveform and the data transmitting method of the third embodiment (see FIG. 24) and a mode using the waveform and the data transmitting method of the seventh embodiment (see FIG. 34).

It is noted that the latch timing for rewriting tone data is different in the third embodiment (FIG. 24) and the seventh embodiment (FIG. 34). Specifically, as is described above, during the time the tone data are latched, the on/off state of the analog switch AS becomes unstable, and thereby, latching has to be performed when the drive waveform is flat. Since the waveform of the third embodiment and the waveform of the seventh embodiment are different in shape, the latch timings for the respective waveforms are different. Accordingly, in the present embodiment, the timing for rewriting tone data within a printing period may be set according to the difference in the drive waveforms used.

For example, in an inkjet recording apparatus, the spreading of ink after the ink droplets land on recording paper may significantly vary depending on the type of recording paper used, and thereby, printing in a number of printing modes are preferably enabled (e.g., normal paper speed printing and glossy paper printing).

In this case, the droplet amounts for the respective droplets (i.e., large, medium, and small droplets) may vary depending on the printing mode, and in turn, the drive waveform may vary. Accordingly, in the present embodiment, the timing for rewriting tone data of one printing period may be set to be adaptable to changes in the droplet amounts. It is noted that when the rewriting timing is fixed, relatively tight restrictions may be imposed on the drive waveform condition (waveform design), and there may be cases in which a drive waveform for discharging the desired droplet amount cannot be designed.

In the following, a ninth embodiment of the present invention is described.

Figure 1:
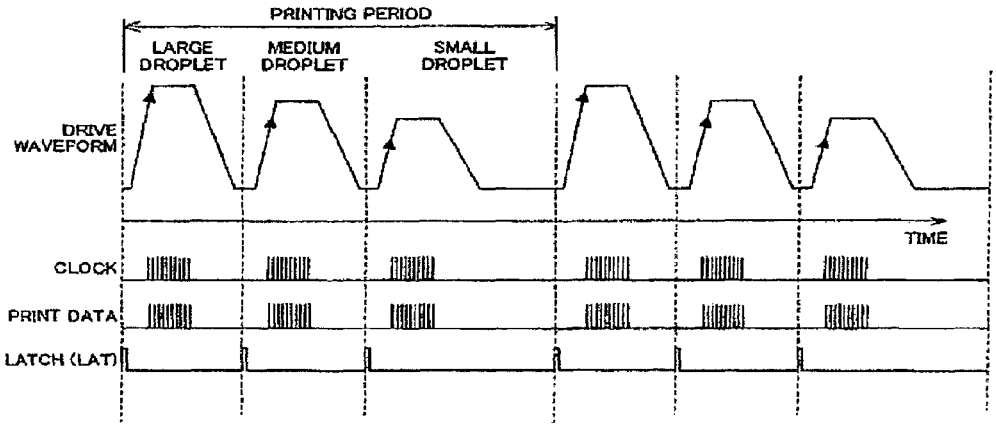
FIG. 1 Prior Art
FIG. 1 is a diagram illustrating a data transmitting method involving transmitting print data with respect to every drive pulse.
Figure 2:
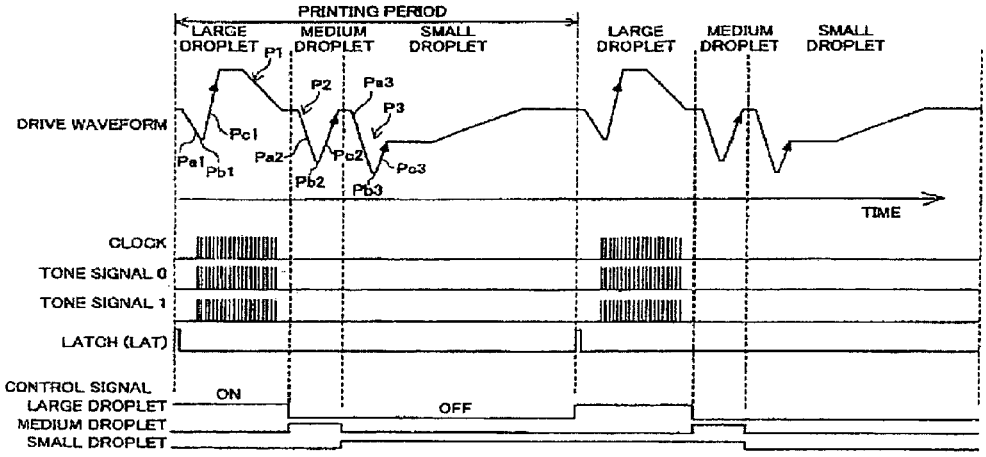
FIG.2 Prior Art
FIG. 2 is a diagram illustrating a data transmitting method involving transmitting tone data once every printing period using a drive waveform having three drive pulses.
Figure 3:
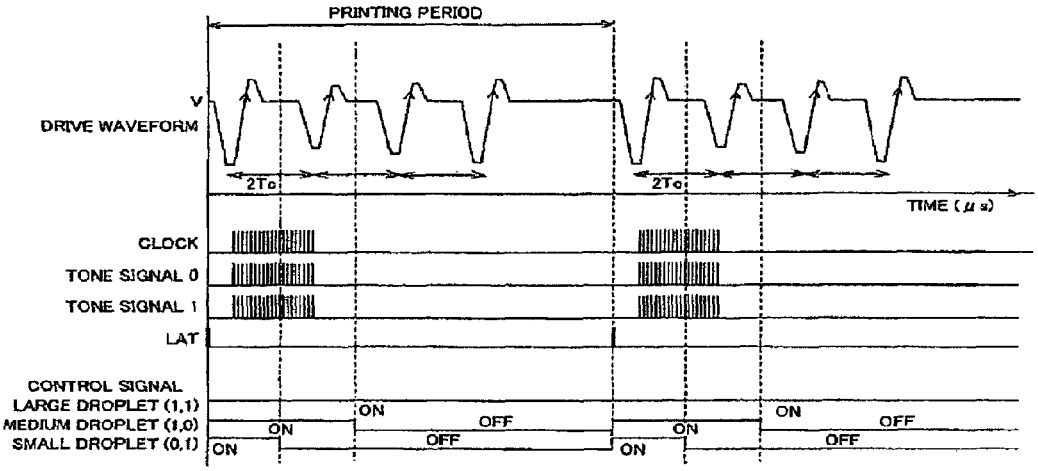
FIG.3 Prior Art
FIG. 3 is a diagram illustrating a data transmitting method involving transmitting tone data once every printing period using a drive waveform having four drive pulses.

In the present embodiment, the printing mode may be switched between a mode using the drive waveform and the data transmitting method of the third embodiment, and the mode using the drive waveform and the data transmitting method shown in FIG. 2 (in which tone data are transmitted once within one printing period).

As is described above, an inkjet recording apparatus may be configured to realize a number of printing modes. It is noted that in a case of printing a high-quality image such as a photographic quality image, the interlaced printing scheme may have to be employed in which case the nozzle pitch does not correspond to the resolution in the sub scanning direction.

In the case of performing such high-quality image printing, a droplet of a substantially large size such as that realized in the third embodiment (see FIG. 24) is not necessary. Specifically, in the present case, density in the sub scanning direction may be increased through interlacing lines formed by small droplets, and thereby, representation of a variety of tone levels within one printing period may not be necessary. Thus, in this case, printing may be performed using the data transmitting method involving transmitting tone data once within one printing period as is described with reference to FIG. 2. It is noted that when a data transmitting method involving transmitting tone data plural times within one printing period is used in this case, the required data transmission time and the tone data generation time may cause inconveniences with respect to the printing speed.

Accordingly, the present embodiment enables selection between transmitting tone data once and transmitting tone data plural times within one printing period. In this way, data transmission suitable for the current printing mode may be selected so that efficiency may be realized with respect to data transmission for a printing mode that does not require a wide range of tone levels (e.g., third through fifth embodiments) or a higher main scanning resolution (e.g., sixth and seventh embodiment).

It is noted that the present embodiment as is described above may be realized simply through adjusting the control part 200 of the imaging apparatus; namely, by changing the sequence of the data transmitting unit 302. In other words, the hardware configurations of the carriage such as the recording head 11 and the head driver 207 do not have to be changed so that the present embodiment may be easily realized.

It is noted that in the embodiments described above, transmission of tone data having a 2 bits/CH data structure is described as a representative example. However, the present invention may equally be applied to embodiments in which data of 3 bits/CH or higher are used in a case where the number of droplets discharged within one printing period exceeds the number of tone levels being represented.

Although the present invention is shown and described with respect to certain preferred embodiments, it is obvious that equivalents and modifications will occur to others skilled in the art upon reading and understanding the specification. The present invention includes all such equivalents and modifications, and is limited only by the scope of the claims.

The present application is based on and claims the benefit of the earlier filing date of Japanese Patent Application No. 2005-059946 filed on Mar. 4, 2005, and Japanese Patent Application No. 2005-063222 filed on Mar. 8, 2005, the entire contents of which are hereby incorporated by reference.

The invention claimed is:

1. An imaging apparatus comprising:

a liquid discharge head configured to discharge recording liquid as one or more recording liquid droplets;

a drive waveform generating unit configured to generate a drive waveform including at least two drive signals within one printing period; and a drive unit configured to input tone data, select a relevant drive signal from the drive waveform via a switch that switches on/off according to the tone data, and apply the selected drive signal to the liquid discharge head;

wherein the drive signals of the drive waveform include a first drive signal for forming one dot with a large droplet in one printing period, and at least one of a second drive signal for forming at least two dots with at least two small droplets in one printing period and a third drive signal for forming at least two dots with at least two medium droplets in one printing period, and wherein the liquid discharge head, the drive waveform generating unit, and the drive unit are configured to realize serial imaging using an imaging mode in which a main scanning resolution is arranged to be higher than a sub scanning resolution except for a case in which one dot is formed by the large droplet within one printing period in which case the main scanning resolution and the sub scanning resolution are arranged to be equal.

2. The imaging apparatus as claimed in claim 1, wherein the imaging mode involves forming an image using a non-interlaced imaging scheme.

3. The imaging apparatus as claimed in claim 1, wherein the first drive signal for forming one dot with the large droplet includes at least one of a drive signal for forming a first dot with a small droplet and a drive signal for forming a second dot with a medium droplet, the first dot being separated from the second dot.

4. The imaging apparatus as claimed in claim 1, wherein the large droplet is formed by discharging a plurality of the recording liquid droplets, and arranging the discharged recording liquid droplets to merge before said discharged recording liquid droplets land on an imaging medium.

5. The imaging apparatus as claimed in claim 1, wherein the large droplet is formed by discharging at least four of the recording liquid droplets.

6. The imaging apparatus as claimed in claim 1, wherein the tone data are switched within one printing period.

7. The imaging apparatus as claimed in claim 1, wherein the recording liquid includes pigment and has a viscosity of at least 5 mPa·s at a temperature of 23° C.

8. The imaging apparatus as claimed in claim 1, further comprising:

a switching unit configured to switch the tone data within one printing period.

9. An imaging apparatus comprising:

a liquid discharge head configured to discharge recording liquid as one or more recording liquid droplets;

a drive waveform generating unit configured to generate a drive waveform including at least two drive signals within one printing period; and a drive unit configured to input tone data, select a relevant drive signal from the drive waveform via a switch that switches on/off according to the tone data, and apply the selected drive signal to the liquid discharge head;

wherein the drive signals of the drive waveform include a first drive signal for forming one dot with a large droplet in one printing period, and at least one of (a) a second drive signal for forming at least two dots with at least two small droplets in one printing period, the at least two dots formed by the at least two small droplets being separated from each other, and (b) a third drive signal for forming at least two dots with at least two medium droplets in one printing period, the at least two dots formed by the at least two medium droplets being separated from each other, and wherein the drive signals of the drive waveform further include another drive signal for forming two dots with a small droplet and a medium droplet in one printing period, the two dots formed by the small droplet and the medium droplet being separated from each other.

10. The imaging apparatus as claimed in claim 9, wherein the first drive signal for forming one dot with the large droplet includes at least one of a drive signal for forming a first dot with a small droplet and a drive signal for forming a second dot with a medium droplet, the first dot being separated from the second dot.

11. The imaging apparatus as claimed in claim 9, wherein the large droplet is formed by discharging a plurality of the recording liquid droplets, and arranging the discharged recording liquid droplets to merge before said discharged recording liquid droplets land on an imaging medium.

12. The imaging apparatus as claimed in claim 9, wherein the large droplet is formed by discharging at least four of the recording liquid droplets.

13. The imaging apparatus as claimed in claim 9, wherein the tone data are switched within one printing period.

14. The imaging apparatus as claimed in claim 9, wherein the recording liquid includes pigment and has a viscosity of at least 5 mPa·s at a temperature of 23° C.

15. The imaging apparatus as claimed in claim 9, further comprising:

a switching unit configured to switch the tone data within one printing period.

* * * * *

UNITED STATES PATENT AND TRADEMARK OFFICE

CERTIFICATE OF CORRECTION

PATENT NO. : 8,057,001 B2
APPLICATION NO. : 11/547952
DATED : November 15, 2011
INVENTOR(S) : Mitsuru Shingyohuchi et al.

It is certified that error appears in the above-identified patent and that said Letters Patent is hereby corrected as shown below:

Replace Title Page, item (86) PCT No: with

-- (86) PCT No.: PCT/JP2006/304658 --

Signed and Sealed this
Twenty-first Day of February, 2012

David J. Kappos

David J. Kappos
*Director of the United States Patent and Trademark Office*